US010319052B2

(12) United States Patent
Miyazaki et al.

(10) Patent No.: US 10,319,052 B2
(45) Date of Patent: Jun. 11, 2019

(54) INFORMATION TERMINAL CONTROL METHOD AND ENERGY CONSERVATION SUPPORT SYSTEM

(71) Applicant: Panasonic Intellectual Property Management Co., Ltd., Osaka (JP)

(72) Inventors: Seiya Miyazaki, Shiga (JP); Minoru Takazawa, Osaka (JP); Wei Zhang, Osaka (JP); Takao Yamaguchi, Osaka (JP); Akio Nakano, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 190 days.

(21) Appl. No.: 15/199,999

(22) Filed: Jul. 1, 2016

(65) Prior Publication Data

US 2017/0031429 A1 Feb. 2, 2017

(30) Foreign Application Priority Data

Jul. 30, 2015 (JP) ..... 2015-150629

(51) Int. Cl.
*G06Q 50/06* (2012.01)

(52) U.S. Cl.
CPC ..... *G06Q 50/06* (2013.01)

(58) Field of Classification Search
CPC ..... G06Q 50/06
USPC ..... 700/291
See application file for complete search history.

(56) References Cited

U.S. PATENT DOCUMENTS

2010/0070091 A1* 3/2010 Watson ..... G06Q 50/06 700/278
2012/0306882 A1* 12/2012 Kashiwagi ..... G01D 4/00 345/440
2015/0148967 A1* 5/2015 Logan ..... G05B 15/02 700/276
2015/0160040 A1* 6/2015 Furukawa ..... H02J 13/0086 340/870.09
2016/0124451 A1* 5/2016 Yoshitani ..... H02J 13/0006 700/291
2016/0127144 A1* 5/2016 Takahashi ..... G08C 17/00 705/27.1
2016/0161963 A1* 6/2016 Fujisawa ..... H02J 13/001 700/295

(Continued)

FOREIGN PATENT DOCUMENTS

JP 2002-176728 6/2002
JP 2004-044457 2/2004
JP 2013-106380 5/2013

*Primary Examiner* — Kenneth M Lo
*Assistant Examiner* — Michael W Choi
(74) *Attorney, Agent, or Firm* — Greenblum & Bernstein, P.L.C.

(57) ABSTRACT

An information terminal control method includes: (a) predicting whether an amount of power consumption in a shop exceeds a target value; (b) when the amount of power consumption in the shop is predicted to exceed the target value, causing a display of an information terminal to display a screen displaying a time period during which the amount of power consumption in the shop is predicted to exceed the target value; and (c) causing the display to display a screen displaying a message that presents an action to reduce the amount of power consumption in the time period.

22 Claims, 15 Drawing Sheets

(56) References Cited

U.S. PATENT DOCUMENTS

| | | | | |
|---|---|---|---|---|
| 2016/0322820 | A1* | 11/2016 | Nakayama | G06Q 50/06 |
| 2017/0207629 | A1* | 7/2017 | Seki | G06Q 50/06 |

* cited by examiner

FIG. 10

| ENERGY-SAVING ACTIONS | DESCRIPTIONS | | |
|---|---|---|---|
| | TREE HOURS OR MORE BEFORE TARGET VALUE IS EXCEEDED | THIRTY MINUTES OR MORE TO LESS THAN THREE HOURS BEFORE TARGET VALUE IS EXCEEDED | LESS THAN THIRTY MINUTES BEFORE TARGET VALUE IS EXCEEDED |
| TIME DURING WHICH WI DOOR IS OPEN | THE CARRYING IN OF MERCHANDIZE THAT ENTAILS THE OPENING OF A DOOR SHOULD BE PERFORMED AT OFF-PEAK TIMES. | THE CARRYING IN OF MERCHANDIZE THAT ENTAILS THE OPENING OF A DOOR SHOULD BE PERFORMED AT OFF-PEAK TIMES. | THE CARRYING IN OF MERCHANDIZE THAT ENTAILS THE OPENING OF A DOOR SHOULD BE SUSPENDED FOR THE TIME BEING. |
| TIME DURING WHICH REFRIGERATOR/FREEZER DOOR IS OPEN | | | |
| ORGANIZATION OF CONTENTS OF REFRIGERATOR/FREEZER | OVERLOADING SHOULD BE PREVENTED BY ORGANIZING THE CONTENTS OF THE REFRIGERATOR/FREEZER, E.G., BY KEEPING THOSE WHICH ARE NOT USED IMMEDIATELY IN THE FREEZER CHEST. | — | — |
| PROPER TEMPERATURE OF AIR CONDITIONER | THE TEMPERATURE OF THE AIR CONDITIONER SHOULD BE SET HIGHER (LOWER) THAN USUAL BY XX°C. | THE TEMPERATURE OF THE AIR CONDITIONER SHOULD BE SET FURTHER HIGHER (LOWER) BY YY°C. | THE TEMPERATURE OF THE AIR CONDITIONER SHOULD BE SET FURTHER HIGHER (LOWER) BY YY°C. |
| TURNING OFF OF BACKROOMWAREHOUSE LIGHTING AND AIR CONDITIONER | UNNECESSARY LIGHTING AND AIR CONDITIONING SHOULD BE ALWAYS THOROUGHLY TURNED OFF. | UNNECESSARY LIGHTING AND AIR CONDITIONING SHOULD BE ALWAYS THOROUGHLY TURNED OFF. | UNNECESSARY LIGHTING AND AIR CONDITIONING SHOULD BE ALWAYS THOROUGHLY TURNED OFF. |
| FRYER OPERATION | FRY COOKING WITH THE FRYER SHOULD BE PERFORMED AT OFF-PEAK TIMES. | FRY COOKING WITH THE FRYER SHOULD BE SUSPENDED FOR THE TIME BEING. | FRY COOKING WITH THE FRYER SHOULD BE SUSPENDED FOR THE TIME BEING. |
| PREVENTION OF INSOLATION (IN SUMMERTIME ONLY) | INSOLATION SHOULD BE REDUCED WITH A BLIND OR THE LIKE WHEN ISOLATION MAKES IT HOT INSIDE THE SHOP. | INSOLATION SHOULD BE REDUCED WITH A BLIND OR THE LIKE WHEN ISOLATION MAKES IT HOT INSIDE THE SHOP. | — |
| TURNING OFF OF IN-SHOP VENTILATION FAN | THE VENTILATION FAN SHOULD BE TURNED OFF TO REDUCE THE AMOUNT OF INFLOW OF OUTSIDE AIR TO REDUCE THE AMOUNT OF POWER THAT IS CONSUMED BY THE AIR CONDITIONER. | THE VENTILATION FAN SHOULD BE TURNED OFF TO REDUCE THE AMOUNT OF INFLOW OF OUTSIDE AIR TO REDUCE THE AMOUNT OF POWER THAT IS CONSUMED BY THE AIR CONDITIONER. | — |
| SPRINKLING OF WATER OVER AREA AROUND OUTDOOR UNIT | WATER SHOULD BE SPRINKLED OVER THE AREA NEAR THE OUTDOOR UNIT IN THE PEAK TIME PERIOD. | WATER SHOULD BE SPRINKLED OVER THE AREA NEAR THE OUTDOOR UNIT EVERY XY MINUTES IN THE PEAK TIME PERIOD. | — |
| TURNING ON AND TURNING OFF OF LIGHT CONTROL | THE INTENSITY OF ILLUMINATION INSIDE AND OUTSIDE THE SHOP SHOULD BE REDUCED. | THE INTENSITY OF ILLUMINATION INSIDE AND OUTSIDE THE SHOP SHOULD BE REDUCED. | — |
| ODEN LID CLOSURE | THE ODEN SHOULD BE COVERED WITH A LID WHEN HEATED IN THE PEAK TIME PERIOD. | THE ODEN SHOULD BE COVERED WITH A LID WHEN HEATED. | — |
| TURNING OFF OF ANTI-SWEAT HEATER (IN WINTERTIME ONLY) | THE WINDOW SHOULD BE WIPED OFTEN FOR DEW CONDENSATION PREVENTION, AND THE HEATER SHOULD BE TURNED OFF. | THE WINDOW SHOULD BE WIPED OFTEN FOR DEW CONDENSATION PREVENTION, AND THE HEATER SHOULD BE TURNED OFF. | — |
| AIR SUPPLY AND EXHAUST OPENING VENTILATION OF SHOWCASE | THE SHOWCASE SHOULD BE ORGANIZED SO THAT THE AIR SUPPLY AND EXHAUST OPENINGS DO NOT BECOME BLOCKED. | THE SHOWCASE SHOULD BE ORGANIZED SO THAT THE AIR SUPPLY AND EXHAUST OPENINGS DO NOT BECOME BLOCKED. | — |
| LOAD-LINE SECUREMENT OF SHOWCASE | THE SHOWCASE SHOULD BE ORGANIZED SO THAT THE LOAD LINE CAN BE SECURED. | THE SHOWCASE SHOULD BE ORGANIZED SO THAT THE LOAD LINE CAN BE SECURED. | — |
| USE OF NIGHT COVER OVER SHOWCASE | — | THE NIGHT COVER SHOULD BE USED OVER THE SHOWCASE ACCORDING TO THE NUMBER OF CUSTOMERS. | THE NIGHT COVER SHOULD BE USED OVER THE SHOWCASE ACCORDING TO THE NUMBER OF CUSTOMERS. |
| SCREENING OF OUTDOOR UNIT FROM THE SUN | THE OUTDOOR UNIT SHOULD BE SCREENED FROM THE SUN. | THE OUTDOOR UNIT SHOULD BE SCREENED FROM THE SUN. | — |

INFORMATION TERMINAL CONTROL METHOD AND ENERGY CONSERVATION SUPPORT SYSTEM

BACKGROUND

1. Technical Field

The present disclosure relates to an information terminal control method and an energy conservation support system for supporting energy conservation in a shop.

2. Description of the Related Art

In recent years, emphasis has been placed on reducing consumption of energy in shops, i.e., on energy conservation, for enhancement in corporate image and improvement in profitability. In particular, corporations that operate a plurality of shops such as convenience stores and supermarkets have been recommending energy conservation in each shop, as an assiduous accumulation of energy conservation in each shop brings about a profound effect.

The following describes examples of technologies for achieving energy conservation. Japanese Unexamined Patent Application Publication No. 2013-106380 discloses a consumption monitoring system. The system sets a given power consumption target within a contract demand. The system calculates total power consumption from the power consumed by each electrical apparatus. In a case where the total power consumption exceeds the power consumption target, the system selects, from among electrical apparatuses that are operating, an electrical apparatus that is to be de-activated. This selection is based on a preset order of priority. The system reports the selected electrical apparatus together with an excess of power consumption. The system then de-activates the selected electrical apparatus at a predetermined timing.

Further, Japanese Patent No. 3564605 discloses a demand control operational support method including a target power setter that sets a target power in advance for each weather condition for each demand control target, a seasonal prediction acquirer that acquires a seasonal prediction from a meteorological company through a network, a target power selector that selects, on the basis of the seasonal prediction thus acquired, a target power under a weather condition corresponding to each demand control target, and a target power supplier that supplies the target power thus selected to the corresponding demand control target through the network.

In the technology disclosed in Japanese Unexamined Patent Application Publication No. 2013-106380, the excess of power consumption is reported when the total power consumption exceeds the power consumption target. For this reason, the total power consumption already exceeds the power consumption target by the time the excess of power consumption is reported. As such, the technology disclosed in Japanese Unexamined Patent Application Publication No. 2013-106380 does not consider improving efficiency in energy conservation by reducing the possibility that the amount of power consumption may exceed the targeted amount of power.

Further, the technology disclosed in Japanese Patent No. 3564605 is intended to select a target power according to seasonal weather information. As such, the technology disclosed in Japanese Patent No. 3564605 cannot improve efficiency in energy conservation by reducing the possibility that the amount of power consumption may exceed the targeted amount of power.

Under such circumstances, there has been a demand for a technology for improving efficiency in energy conservation by reducing the possibility that the amount of power consumption may exceed the targeted amount of power.

SUMMARY

One non-limiting and exemplary embodiment provides an information terminal control method and an energy conservation support system for improving efficiency in energy conservation by reducing the possibility that an amount of power consumption may exceed a targeted amount of power.

Additional benefits and advantages of the disclosed embodiments will be apparent from the specification and Figures. The benefits and/or advantages may be individually provided by the various embodiments and features of the specification and drawings disclosure, and need not all be provided in order to obtain one or more of the same.

In one general aspect, the techniques disclosed here feature an information terminal control method including: (a) predicting whether an amount of power consumption in a shop exceeds a target value; (b) when the amount of power consumption in the shop is predicted to exceed the target value, causing a display of an information terminal to display a screen displaying a time period during which the amount of power consumption in the shop is predicted to exceed the target value; and (c) causing the display to display a screen displaying a message that presents an action to reduce the amount of power consumption in the time period.

The present disclosure improves efficiency in energy conservation by reducing the possibility that the amount of power consumption may exceed the targeted amount of power.

These general and specific aspects may be implemented using a system and a method, and any combination of systems and methods.

BRIEF DESCRIPTION OF THE DRAWINGS

FIG. 10 is a table showing examples of messages including energy-saving actions and specific descriptions of the energy-saving actions;

DETAILED DESCRIPTION

Figure 1A:
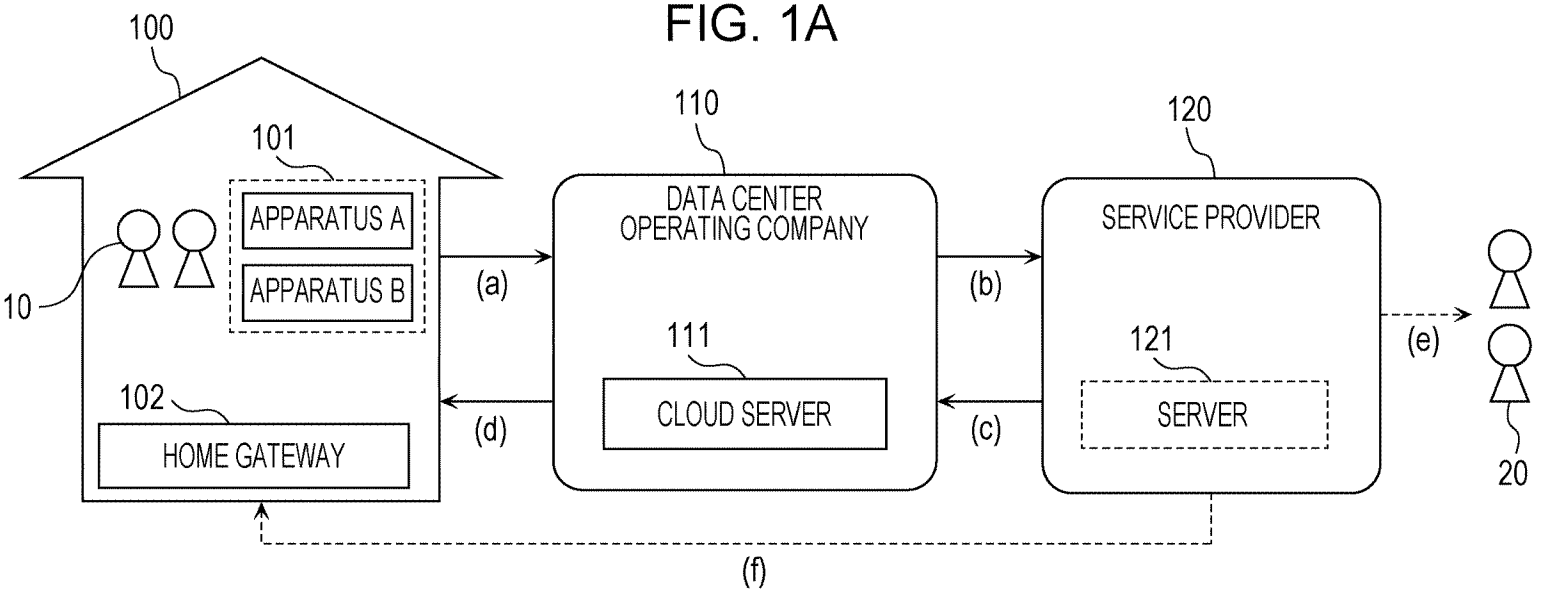
FIG. 1A is a diagram showing an example of an overview of an information providing system according to an embodiment of the present disclosure.

An embodiment of the present disclosure is described below with reference to the drawings. FIG. 1A is a diagram showing an example of an overview of an information providing system according to the embodiment of the present disclosure. A group 100 is a group such as a corporation, an organization, or a family regardless of its size.

The group 100 includes a plurality of apparatuses 101, namely apparatuses A and B, and a home gateway 102. Examples of the plurality of apparatuses 101 include apparatuses that are connectable to the Internet (e.g., a smartphone, a PC, and a TV) and apparatuses that are not connectable to the Internet by themselves (e.g., a microwave oven, a light, a washing machine, and a refrigerator).

Other example may include apparatuses that are not connectable to the Internet by themselves but become connectable to the Internet via the home gateway 102. Further, the group 100 include users 10 who use the plurality of apparatuses 101.

A data center operating company 110 includes a cloud server 111. The cloud server 111 is a virtualized server that cooperates with various apparatuses via the Internet. The cloud server 111 mainly manages huge data (big data) that are difficult to handle with an ordinary database management tool or the like.

The data center operating company 110 performs data management, management of the cloud server 111, operation of a data center that performs the data management and the management of the cloud server 111, and the like. Details of services that are provided by the data center operating company 110 will be described below.

Figure 1B:
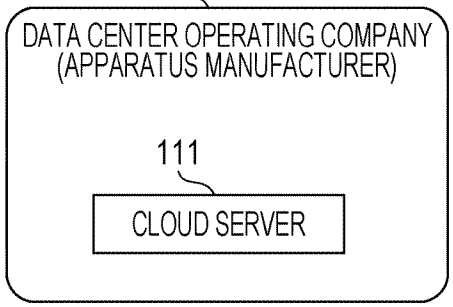
FIG. 1B is a diagram showing an example in which a data center operating company is an apparatus manufacturer.

Note here that the data center operating company 110 is not limited to a company that performs only the data management, the operation of the cloud server 111, and the like. FIG. 1B is a diagram showing an example in which the data center operating company 110 is an apparatus manufacturer.

For example, in a case where an apparatus manufacturer who develops and manufactures one of the plurality of apparatuses 101 also performs the data management, the management of the cloud server 111, and the like, the apparatus manufacturer corresponds to the data center operating company 110 as shown in FIG. 1B.

Figure 1C:
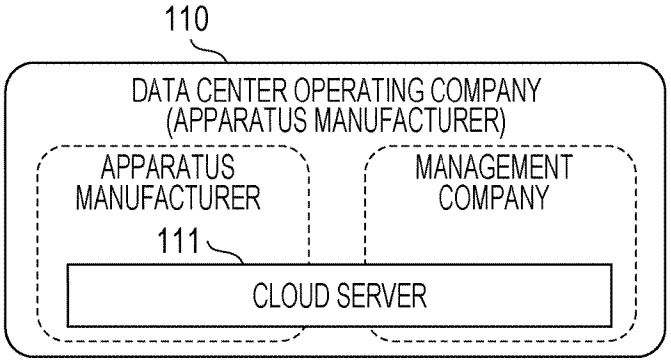
FIG. 1C is a diagram showing an example in which the data center operating company is an apparatus manufacturer and a management company.

Further, the data center operating company 110 is not limited to one company. FIG. 1C is a diagram showing an example in which the data center operating company 110 is an apparatus manufacturer and a management company. For example, in a case where the apparatus manufacturer and the management company perform the data management and the management of the cloud server 111 in a cooperative or sharing manner, both or either of them correspond(s) to the data center operating company 110.

With continued reference to FIG. 1A, the service provider 120 possesses a server 121. The term "server 121" here encompasses a server that, regardless of its size, is constituted, for example, by a memory and the like in a PC for personal use. Alternatively, there may be a case where the service provider 120 possesses no server 121.

It should be noted that the home gateway 102 is not essential to the service described above. For example, the home gateway 102 is not needed, for example, in a case where the cloud server 111 manages all data. Alternatively, there may be a case where there is no apparatus that is not connectable to the Internet by itself, such as a case where all apparatuses in the home are connected to the Internet.

The following describes the flow of information in the service described above. First, the apparatus A or B of the group 100 transmits each piece of log information to the cloud server 111 of the data center operating company 110. The cloud server 111 accumulates log information from the apparatus A or B ((a) of FIG. 1A).

An example of the "log information" here is information that indicates the status of operation in the plurality of apparatuses 101, the date and time of operation in the plurality of apparatuses 101, or the like. Examples include microwave oven cooking information, a TV viewing history, recorder timer recording information, the date and time of operation of and the amount of laundry washed by a washing machine, or the date and time and the number of times a refrigerator is opened and closed. However, the term "log information" is not limited to these examples but refers to all information that can be acquired from every apparatus.

There is also a case where log information is provided directly to the cloud server 111 from the plurality of apparatuses 101 per se via the Internet. Alternatively, log information may be temporarily accumulated in the home gateway 102 from the plurality of apparatuses 101 and then provided from the home gateway 102 to the cloud server 111.

Next, the cloud server 111 of the data center operating company 110 provides the accumulated log information to the service provider 120 in a constant unit. This unit may be a unit in which the data center operating company 110 can provide the accumulated information to the service provider 120 in an organized manner, or may be a unit requested by the service provider 120. Further, although the unit has just been described as being constant, the unit does not need to be constant, and the amount of information that is provided may vary depending on the situation.

The log information is stored as needed in the server 121 of the service provider 120 ((b) of FIG. 1A). Then, the service provider 120 organizes the log information into information suitable for a service that is provided to users, and provides the organized information to the users.

The users to whom the information is provided may be the users 10, who use the plurality of apparatuses 101, or may be external users 20. Then, the information may for example be provided directly to the users from the service provider 120 ((e) and (f) of FIG. 1A). Further, the information may be provided to the users by traveling again through the cloud server 111 of the data center operating company 110 ((c) and (d) of FIG. 1A).

Furthermore, the cloud server 111 of the data center operating company 110 may organize the log information into information suitable for the service that is provided to the users, and provides the organized information to the service provider 120.

It should be noted that the users 10 and 20 may be different persons or the same persons.

Figure 2:
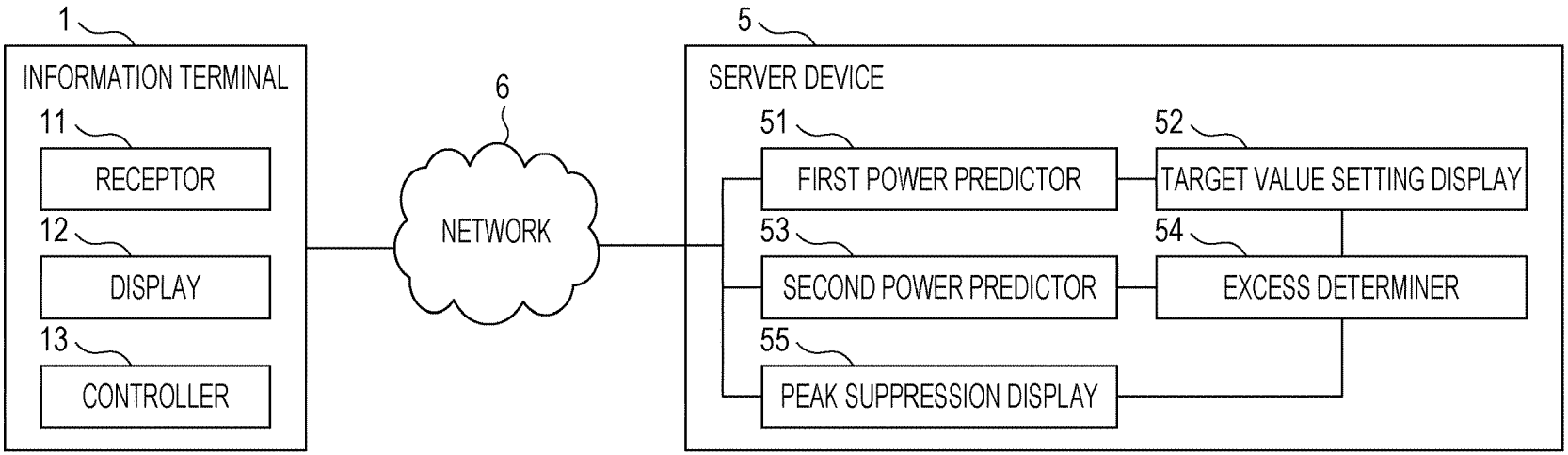
FIG. 2 is a diagram showing an example of a configuration of an energy conservation support system according to the embodiment of the present disclosure.

The following describes an example of an energy conservation support system according to the embodiment of the present disclosure. FIG. 2 is a diagram showing an example of a configuration of the energy conservation support system according to the embodiment of the present disclosure. As shown in FIG. 2, the energy conservation support system 200 includes an information terminal 1 provided in a shop, a server device 5, and a network 6. The information terminal 1 and the server device 5 are connected to each other via the network 6. The network 6 may be a wired network, a wireless network, or a combination of these networks.

Figure 3:
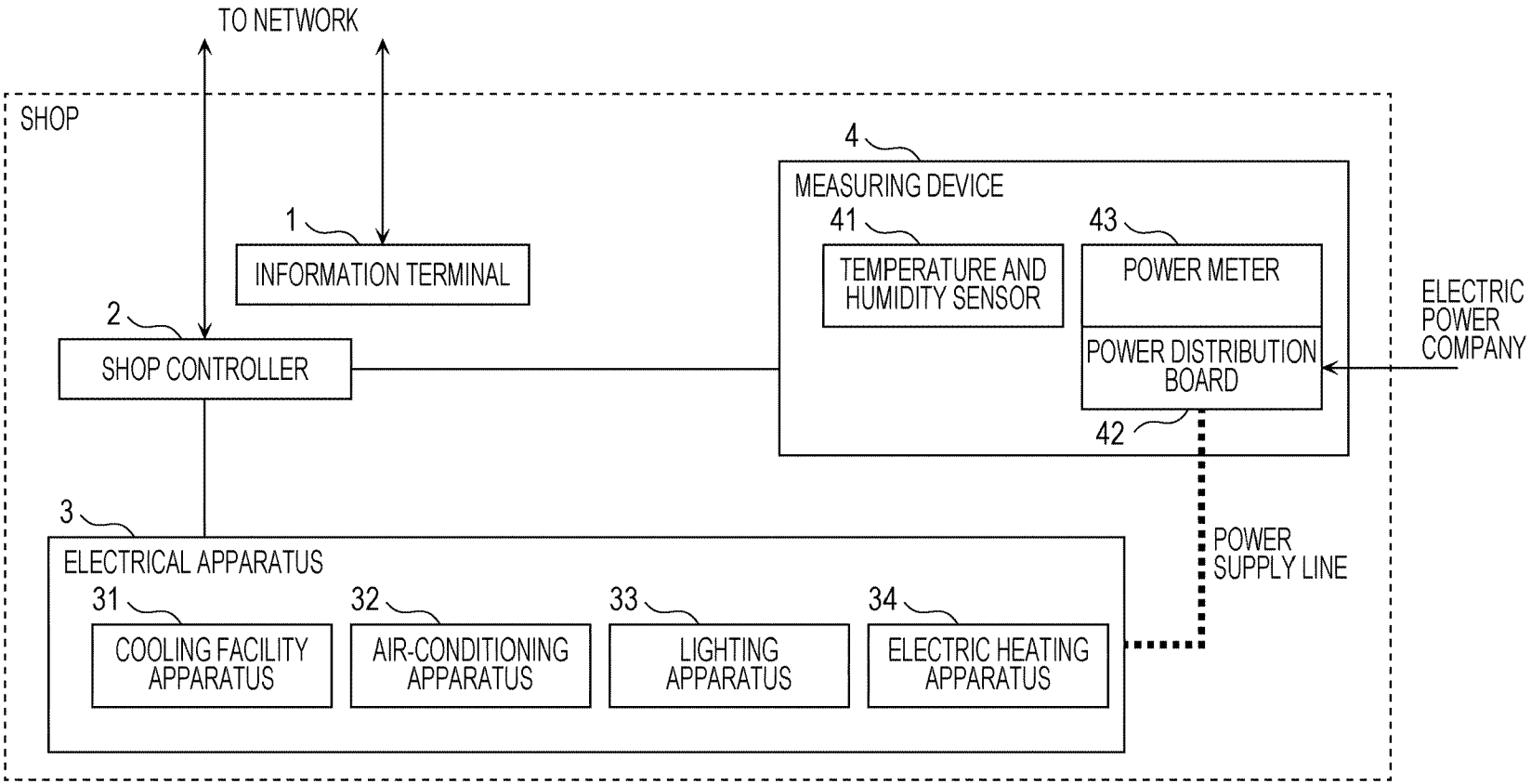
FIG. 3 is a diagram showing components that are installed in a shop.

It should be noted that the shop is one shop of a corporation having a plurality of shops such as convenience stores or supermarkets. As shown in FIG. 3, a shop controller 2, an electrical apparatus 3, and a measuring apparatus 4 are installed in the shop in addition to the information terminal 1 described above. FIG. 3 is a diagram showing the components that are installed in the shop. Although FIGS. 2 and 3 show an example in which there are only one shop (information terminal 1, shop controller 2, electrical apparatus 3, measuring apparatus 4) and one server device 5, there may be two or more shops and two or more server devices 5.

In such a corporation having a plurality of shops, the conservation of energy in each shop is important in terms of improvement in profitability and image strategy of the corporation as a whole. In each shop according to the present embodiment, a shop staff working at the shop is making various energy-saving efforts. The energy conservation support system 200 is intended to support such efforts. In the present disclosure, the term "shop staff" encompasses not only an employee of a shop, but also a shop manager or personnel in a corporation that operates the shop who decide on a shop operation policy.

Figure 4:
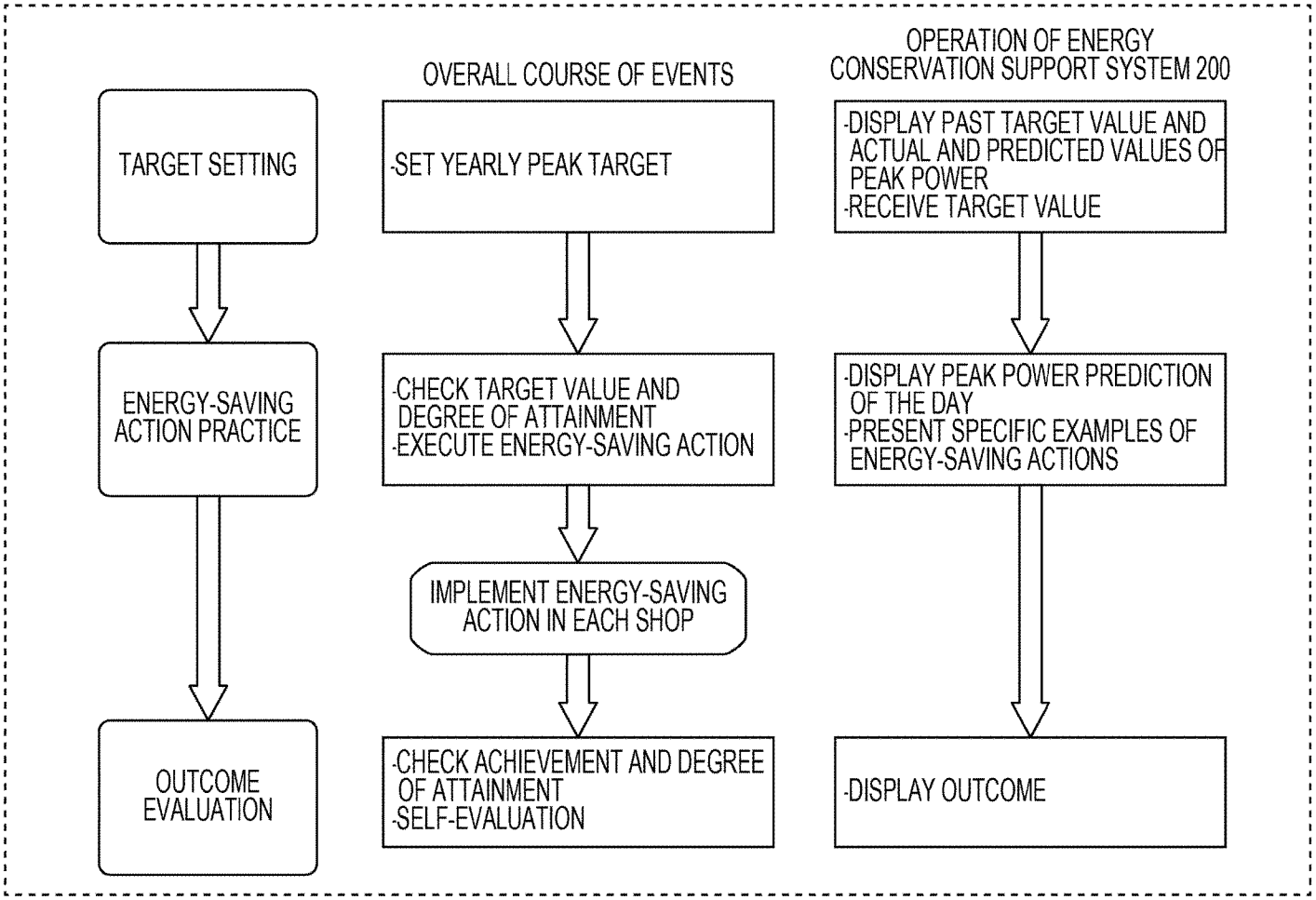
FIG. 4 is a diagram for explaining an example of the flow of efforts of a shop to conserve energy.

FIG. 4 is a diagram for explaining an example of the flow of efforts of a shop to conserve energy. The efforts shown in FIG. 4 are intended to conserve energy by reducing a peak value of the amount of power consumption in a shop so that the peak value is equal to or smaller than a predetermined value (target value). The peak value of the amount of power consumption is a peak value of the amount of power consumption during a predetermined period of time, and the predetermined period of time may for example be one day, one month, or the like. The amount of power consumption in the shop may be a total value of the amount of power that is consumed by all power-consuming apparatuses installed in the shop, or may be a total value of the amount of power that is consumed by one or some of the power-consuming apparatuses installed in the shop. That is, the amount of power consumption in the shop needs only be a total value of the amount of power that is consumed by at least one or some of all of the power-consuming apparatuses installed in the shop. Further, the efforts shown in FIG. 4 include a target setting stage, an energy-saving action practice stage, and an outcome evaluation stage. At each of these stages, the shop staff executes the energy-saving efforts with the support of the energy conservation support system 200. The following describes the action of the shop staff at each stage and the operation of the energy conservation support system 200.

First, at the target setting stage, the shop staff sets a target value in order to suppress the peak value of the amount of power consumption in the shop. The target value serves as a value to which the shop staff suppresses the peak value. The peak value of the amount of power consumption is hereinafter referred to as "peak power". The target value is set, for example, on the basis of past target values, actual values of the peak power, and a long-term, e.g., monthly or several months' predicted values of the peak power, and the like.

At the target setting stage, the energy conservation support system 200 calculates several months' predicted values of the peak power on the basis of past actual values of the peak power and the amount of power consumption in the shop, next several months' weather prediction information, and the like. Then, the energy conservation support system 200 displays the predicted values thus calculated and the past actual values so that the shop staff may refer to, thereby supporting the setting of a target value by the shop staff and receiving the input of the target value set by the shop staff.

Once the target value is thus set at the target setting stage, the flow then shifts to the day-to-day energy-saving action practice stage. At the energy-saving action practice stage, the shop staff daily checks the target value and the degree of attainment of the target and, at the same time, executes as many energy-saving actions as possible to attain the target. It should be noted that the energy-saving actions are various actions that are performed by the shop staff to suppress the peak power. Details of the energy-saving actions will be described below.

At the energy-saving action practice stage, the energy conservation support system 200 predicts and displays a day's (24 hours') amount of power consumption every short-term second predetermined period of time, e.g., every second unit period of time (e.g., thirty minutes). Further, on the basis of the predicted value and the target value, in a case where the predicted value exceeds the target value, the energy conservation support system 200 presents, to the shop staff, a message that presents an action to reduce the amount of power consumption in a time period during which the predicted value exceeds the target value. It should be noted that the amount of power consumption during the second unit period of time may be an integrated value of instantaneous values of the amount of power consumption during the second unit period of time, or may be an instantaneous maximum value of the amount of power consumption during the second unit period of time. Further, the time period during which the predicted value exceeds the target value may be hereinafter referred to as "peak time period".

Then, the flow shifts to the outcome evaluation stage, at which the results achieved by the energy-saving actions executed at the aforementioned energy-saving action practice stage are evaluated. At the outcome evaluation stage, the energy conservation support system 200 displays whether the peak power was successfully suppressed. This allows the shop staff to recognize whether the target was attained.

<Energy Conservation Support System 200 and Components Installed in Shop>

The foregoing has described examples of efforts of each shop to conserve energy and the operation of the energy conservation support system 200 at each stage of the efforts. The following describes, with reference to FIGS. 2 and 3, the energy conservation support system 200 and each of the components installed in the shop.

The information terminal 1 is a terminal including a display (not illustrated), and is installed in the shop. A desirable example of the information terminal 1 is a tablet terminal. The information terminal 1 communicates with the server device 5 via a communication device (not illustrated).

As shown in FIG. 2, the information terminal 1 includes a receptor 11, a display 12, and a controller 13. The receptor 11 is an operation-receiving device, such as a touch panel, that receives an operation performed by an operator such as a shop staff of a shop. The display 12 is a display device, such as a liquid crystal display or an organic EL display, that displays various types of screens that will be described below. The display 12 displays thereon the total amount of power consumption in the shop, the peak power, or the energy-saving actions. The controller 13 controls the display 12. Specifically, the controller 13 causes the display 12 to display the total amount of power consumption in the shop, the peak power, or the energy-saving actions on the basis of information received from the server device 5 via the network 6. Further, the controller 13 may cause the display 12 to display a screen corresponding to the content of an instruction from the operator as received by the receptor 11. The controller 13 may transmit, to the server device 5 via a cable or wireless communication device (not illustrated), the content of the instruction from the operator as received by the receptor 11. It is desirable that the information terminal 1 be configured, for example, to perform wireless communication with an access point installed in the shop via the communication device and perform communication with the server device 5 via the network 6 in a given location in the shop.

It should be noted that the information terminal 1 does not necessarily be a tablet terminal that is capable of wireless communication. The information terminal 1 needs only be a terminal device, such as a stationary desktop PC (personal computer) or a portable laptop PC, that includes both a display and an input device.

The shop controller 2 is a centralized controller for collectively controlling the electrical apparatus 3 and the measuring apparatus 4 in the shop. The shop controller 2 for example grasps the operating state of or controls the operation of the electrical apparatus 3 according to an operation performed by the shop staff or the like. The shop controller 2 also transmits information such as the operating state of the electrical apparatus 3 or a result of a measurement performed by the measuring apparatus 4 to the server device 5 via the network 6.

The shop controller 2 performs management of the operation of the electrical apparatus 3 in the shop, management of the result of the measurement performed by the measuring apparatus 4, and the like. Specifically, the shop controller 2 is a computer and includes an input device (not illustrated). The input device is intended, for example, to input the setting of the operating state of the electrical apparatus 3 and the like. That is, for example, the shop controller 2 performs operative or inoperative control on each electrical apparatus 3, changes the operating temperature of each electrical apparatus 3, or changes the brightness of each electrical apparatus 3 according to the input to the input device. Further, the shop controller 2 acquires information regarding temperature and humidity from the measuring apparatus 4 or acquires information regarding the amount of power that is consumed by the electrical apparatus 3, adds shop-specifying information (such as a shop ID) to the information, and transmits the information to the server device 5. It is desirable that the shop controller 2 be installed in a location, such as an office or backyard of the shop, where only the shop staff can operate the shop controller 2.

The electrical apparatus 3 includes various types of apparatuses that operate on electricity. Examples of these apparatuses include a cooling facility apparatus 31, an air-conditioning apparatus 32, a lighting apparatus 33, and an electric heating apparatus 34. These electrical apparatuses 3 are installed in the shop. The cooling facility apparatus 31 is an apparatus, such as a refrigerator or a freezer, for cooling merchandise. The air-conditioning apparatus 32 is for example an air conditioner. The lighting apparatus 33 is an apparatus such as a fluorescent lamp or an LED. The electric heating apparatus 34 is an apparatus, such as a fryer, an oden (a Japanese dish containing all kinds of ingredients cooked in a special broth of soy sauce, sugar, sake, etc.) pot, or a heat retainer, for heating merchandise.

The measuring apparatus 4 includes a temperature and humidity sensor 41, a power distribution board 42, and a power meter 43. The measuring apparatus 4 is installed in the shop. The temperature and humidity sensor 41 measures the indoor and/or outdoor temperature and humidity of the shop, generates information regarding the temperature and humidity, and outputs the information to the shop controller 2. The power distribution board 42 distributes, to each component of the electrical apparatus 3, power supplied from an electric power company. The distribution of power by the power distribution board 42 is changed, for example, according to the content of control on each component of the electrical apparatus 3 by the shop controller 2. The power meter 43 measures the power used by each component of the electrical apparatus 3, generates information regarding the amount of power consumption, and outputs the information to the shop controller 2.

The server device 5 acquires information such as the amount of power consumption in the shop from the shop controller 2 installed in the shop via the communication device thereof (not illustrated) and the network 6, performs predetermined information processing, and transmits screen information that causes the information terminal 1 provided in the shop to perform a predetermined display. It is desirable that the server device 5 be a so-called cloud server that is achieved by a plurality of computers connected to a network such as the Internet. As shown in FIG. 2, the server device 5 includes a first power predictor 51, a target value setting display 52, a second power predictor 53, an excess determiner 54, and a peak suppression display 55.

The first power predictor 51 predicts a time shift in peak power in a shop over a long-term first predetermined period of time, e.g., a first predetermined period of time that is longer than one day. Specifically, the first power predictor 51 may predict the peak power during each first unit period of time (e.g., one month) over the next first predetermined period of time (e.g., several months). This prediction is made on the basis of the past actual values of the peak power or the amount of power consumption in the shop and the like in consideration of changes in temperature over the period of prediction, changes in humidity over the period of prediction, and the like. Specifically, the first power predictor 51 predicts the current month's peak power by adding, to the actual values of the amount of power consumption or the peak power in the same month in the previous year, weights corresponding to the changes in temperature, humidity, or the like over the same month in the previous year and the current month. The first power predictor 51 predicts the peak power over the next several months by performing such processing over the next several months and outputs the peak power to the target value setting display 52 as information regarding the long-term peak power prediction. It should be noted that information regarding the changes in temperature and humidity over the same month in the previous year and the current month needs only be acquired, for example, on the Internet.

The target value setting display 52 generates, on the basis of the information regarding the long-term peak power prediction made by the first power predictor 51, information regarding a target value setting screen for prompting the shop staff to set a target value, and transmits the information regarding the screen to the information terminal 1. Then, the target value setting display 52 stores, in a database (not illustrated), the set value (target value) inputted by the shop staff via the information terminal 1, and outputs information regarding the set value to the excess determiner 54. It should be noted that the information regarding the target value setting screen is information that is necessary for the display 12 to display the target value setting screen and, for example, is image data representing the target value setting screen. Further, the target value setting display 52 transmits the information regarding the target value setting screen as appropriate to the information terminal 1. For example, the target value setting display 52 may transmit the information to the information terminal 1 at a preset point of time during a single day, may transmit the information to the information terminal 1 at regular intervals (e.g., every one hour) during a single day, or may transmit the information to the information terminal 1 when the receptor 1 has received a display request for display of the target value setting screen from the operator.

The second power predictor 53 a time shift in amount of power consumption in a shop over a short-term second predetermined period of time, e.g., a second predetermined period of time that is equal to or shorter than one day. Specifically, the second power predictor 52 predicts the amount of power consumption during each second unit period of time (e.g., thirty minutes) over the next second predetermined period of time (e.g., 24 hours). This prediction is made on the basis of the past actual values of the peak power or the amount of power consumption in the shop and the like in consideration of changes in temperature over the period of prediction, changes in humidity over the period of prediction, and the like. Specifically, for example, the second power predictor 53 reads out, from a database (not illustrated), the actual value of the amount of power consumption or the peak power on a day of similar temperature and humidity, and predicts the peak power during the same time period on the basis of the actual value. The second power predictor 53 predicts the amount of power consumption during each second unit period of time (e.g., thirty minutes) over the next second predetermined period of time (e.g., 24 hours) by performing such processing, and outputs the amount of consumption to the excess determiner 54 as information regarding the time shift in amount of power consumption that is predicted over the second predetermined period of time (e.g., one day). It should be noted that the amount of power consumption during the second unit period of time may be an integrated value of instantaneous values of the amount of power consumption during the second unit period of time, or may be an instantaneous maximum value of the amount of power consumption during the second unit period of time. Further, the peak power during the first unit period of time (e.g., one month) may be the largest value among the amounts of power consumption during each second unit period of time (e.g., thirty minutes) in the first predetermined period of time.

The excess determiner 54 acquires, from the target value setting display 52, the information regarding the target value and acquires, from the second power predictor 53, the information regarding the time shift in amount of power consumption that is predicted over the second predetermined period of time. On the basis of these pieces of information, the excess determiner 54 compares a predicted value of the amount of consumption with the target value. The excess determiner 54 outputs information regarding a result of the comparison to the peak suppression display 55. The first power predictor 51 and the excess determiner 54 are an example of the predictor of the present disclosure.

In a case where a predicted value of the amount of consumption in a certain time period exceeds the target value, the peak suppression display 55 generates information regarding a screen (message display screen) containing a message that presents an action to reduce the amount of power consumption during the time period in order to reduce the amount of power consumption in the time period including the peak power. Then, the peak suppression display 55 transmits the information regarding the message display screen thus generated to the information terminal 1. The controller 13 of the information terminal 1 causes the display 12 to display the message display screen to prompt the shop staff to perform the energy-saving action. This prevents the peak power from exceeding the target value in the shop. It should be noted that the information regarding the message display screen is information that is necessary for the display 12 to display the message display screen and, for example, is image data representing the message display screen. Further, the peak suppression display 55 transmits the information regarding the message display screen as appropriate to the information terminal 1. For example, the peak suppression display 55 may transmit the information to the information terminal 1 at a preset point of time during a single day, may transmit the information to the information terminal 1 at regular intervals (e.g., every one hour) during a single day, or may transmit the information to the information terminal 1 when the receptor 1 has received from the operator a display request to check the message.

Although, in the present example, the server device 5 includes the first power predictor 51, the target value setting display 52, the second power predictor 53, the excess determiner 54, and the peak suppression display 55, the information terminal 1 or the shop controller 2 may include one, some, or all of these components. Alternatively, the first power predictor 51, the target value setting display 52, the second power predictor 53, the excess determiner 54, and the peak suppression display 55 may be dispersedly arranged in the server device 5, the information terminal 1, and the shop controller 2. Alternatively, at least one of the server device 5 includes the first power predictor 51, the target value setting display 52, the second power predictor 53, the excess determiner 54, and the peak suppression display 55 may be dividedly arranged in the server device 5 and at least one of the information terminal 1 and the shop controller 2. Specifically, for example, the first power predictor 51 may be dividedly arranged in the server device 5 and the information terminal 1 so that the dividedly-arranged apparatuses cooperate with each other to achieve the function of the first power predictor 51. It should be noted that when the information terminal 1 includes the first power predictor 51, the target value setting display 52, the second power predictor 53, the excess determiner 54, and the peak suppression display 55, information such as the result of the measurement performed by the measuring apparatus 4, which was sent from the shop controller 2 to the server device 5, is transmitted to the information terminal 1.

<Detailed Example of Operation of Energy Conservation Support System 200>

The foregoing has described the energy conservation support system 200 and the components installed in the shop. The following details an example of operation of the energy conservation support system 200 at each stage of the energy-saving actions shown in FIG. 4.

[Operation of Displaying Information for Setting Target Value and Operation of Receiving Target Value]

First, the operation of, at the target setting stage shown in FIG. 4, displaying information for prompting a shop staff to set a target value and receiving the input of the target value by the shop staff is described. In the beginning, the first power predictor 51 makes a peak prediction in a shop (hereinafter referred to as "shop A") during each long period of time (e.g., one month) over the next several months. Specifically, at a specified time, e.g., at the beginning (on the first day) of a month, the first power predictor 51 makes predictions on the peak power in the shop A for three months including the current month. As mentioned above, these predictions are made, for example, by adding, to the actual values of the amount of power consumption or the peak power in the shop A in the same month in the previous year, weights corresponding to the changes in temperature and humidity over the same month in the previous year and the current month. The peak power during each month may for example be the largest value among the amounts of power consumption during each second unit period of time in each month.

Figure 5:
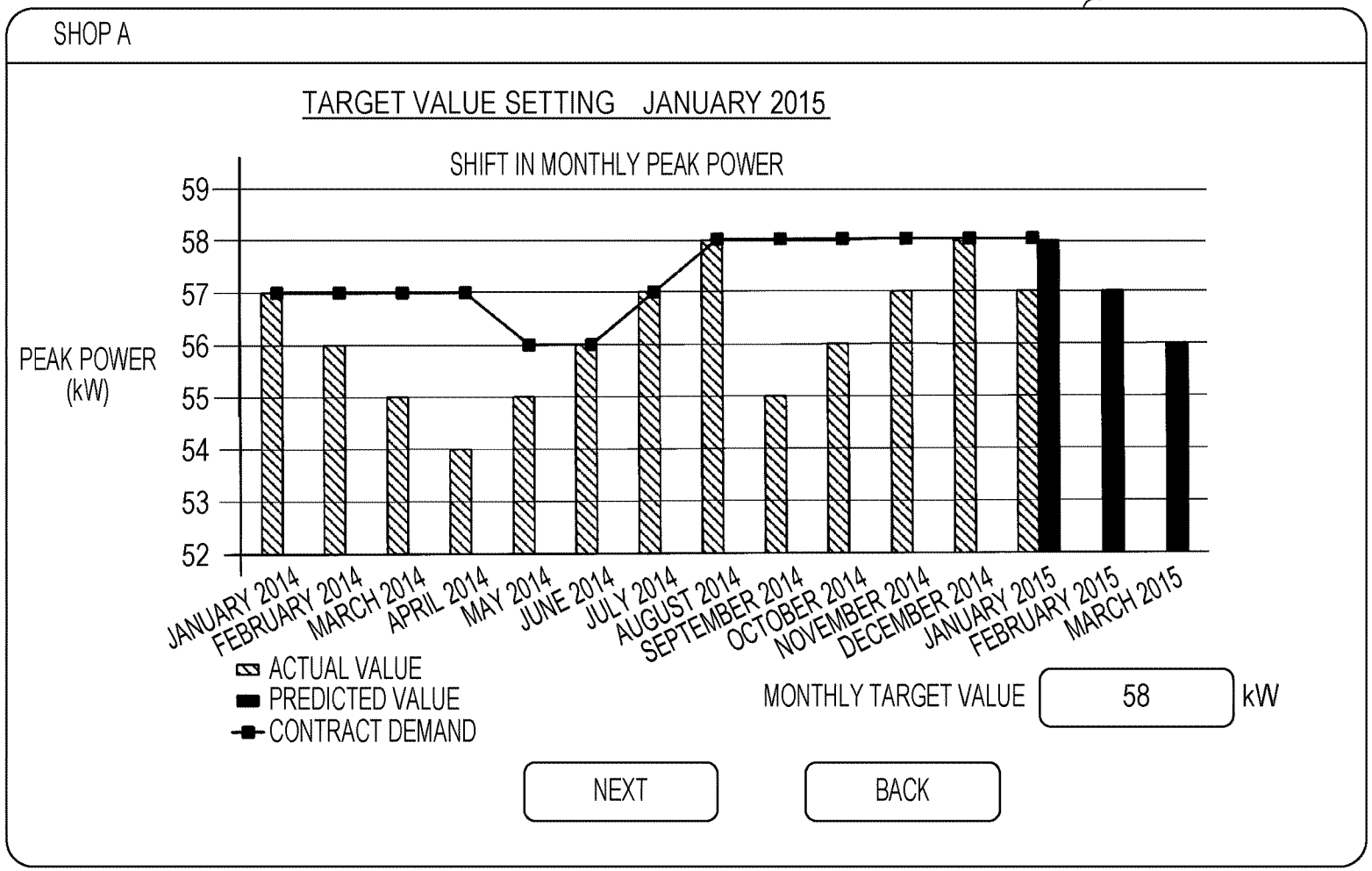
FIG. 5 is a diagram showing an example of a target value setting screen that is displayed on an information terminal.

The first power predictor 51 outputs, to the target value setting display 52, information regarding the predicted values of the peak power during the long-term first predetermined period of time thus predicted. The target value setting display 52 generates information regarding a screen containing information for causing a target value to be set. The controller 13 causes the display 12 of the information terminal 1 of the shop A to display the screen containing the information for causing a target value to be set. The receptor 11 receives the input of a target value to the receptor 11 of an information terminal 1 by a shop staff of the shop A. FIG. 5 is a diagram showing an example of a target value setting screen that is displayed on the information terminal 1.

The target value setting screen SC1 shown in FIG. 5 is a screen that, for the shop A for example, the controller 13 causes the display 12 to display on the basis of the information regarding the screen generated by the target value setting display 52 on the basis of information regarding the past amounts of power consumption stored in advance in a database (not illustrated) of the server device 5. FIG. 5 shows the target value setting screen SC1 for January 2015 as an example. The target value setting screen SC1 shows a bar graph that uses hatched boxes to represent the actual values of the peak power over the past one year, i.e., from January 2014 to January 2015. Further, the bar graph shown on the target value setting screen SC1 also uses black boxes to represent the predicted values over three months from January 2015.

The shop staff of the shop A sets a target value with reference to the target value setting screen SC1 displayed on the display 12 and inputs the target value thus set via the receptor 11. Specifically, for example, in a case where the shop staff sets the target value to 58 kW, which is the predicted value of the peak power for the current month, the shop staff inputs the set value of 58 kW into an input field via the receptor 11 of the information terminal 1. The input field is a field, provided in a lower portion of the setting screen SC1, into which to input a target value. The controller 13 of the information terminal 1 having received the input via the receptor 11 transmits information regarding the target value thus inputted to the server device 5 via the communication device (not illustrated) of the information terminal 1. The server device 5 transmits the information regarding the target value to the excess determiner 54 and stores it in the database (not illustrated), whereby the setting of the target value for January 2015 by the shop A is completed.

Figure 6:
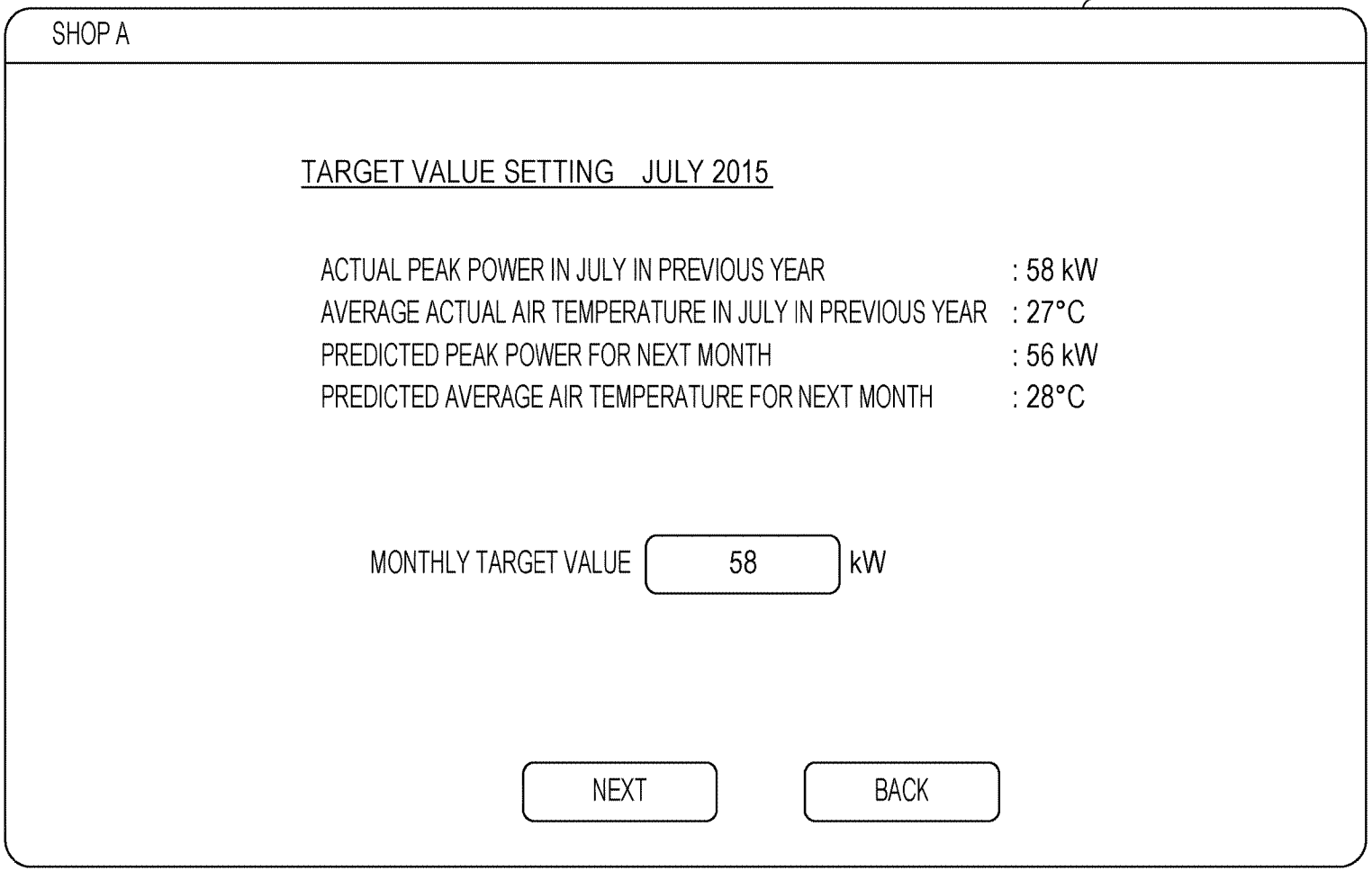
FIG. 6 is a diagram showing another example of a target value setting screen.

FIG. 6 is a diagram showing another example of a target value setting screen. The target value setting screen SC2 shown in FIG. 6 shows numbers representing an actual value of the amount of power consumption in the past and a predicted value for the current month or later. The target value setting screen SC2 shown in FIG. 6 displays only the actual values of the amount of power consumption and air temperature in the same month in the previous year and the predicted value of the amount of power consumption and the forecast value of air temperature in the next month. Alternatively, for example, the target value setting screen SC2 shown in FIG. 6 may display actual values in the months preceding and following the same month in the previous year and predicted values in the month after next or later.

[Short-Term Peak Prediction Operation]

Next, the operation of, at the energy-saving action practice stage shown in FIG. 4, predicting the amount of power consumption during a short-term second predetermined period of time and displaying predicted values. First, the second power predictor 53 of the server device 5 predicts the amount of power consumption in the shop A during the second predetermined period of time. For example, at a predetermined point of time (e.g., every three hours from 12:00 a.m.) everyday, the second power predictor 53 predicts the amount of power consumption in the shop A during each second unit period of time (e.g., thirty minutes) over the next second predetermined period of time (e.g., 24 hours). As mentioned above, these predictions are made, for example, on the basis of the actual values of the amount of power consumption or the peak power on a day of similar temperature and humidity.

Information regarding the predicted value of the amount of power consumption during the second predetermined period of time as predicted by the second power predictor 53 is outputted to the excess determiner 54.

[Peak Excess Determination Operation and Peak Power Predicted Value Display Operation]

The excess determiner 54 compares the predicted values of the peak power with the target value on the basis of the information regarding the target value as acquired from the information terminal and the information regarding the predicted values of the amount of power consumption during the second predetermined period of time as acquired from the second power predictor 53, and determines whether there is a predicted value that exceeds the target value.

Figure 7:
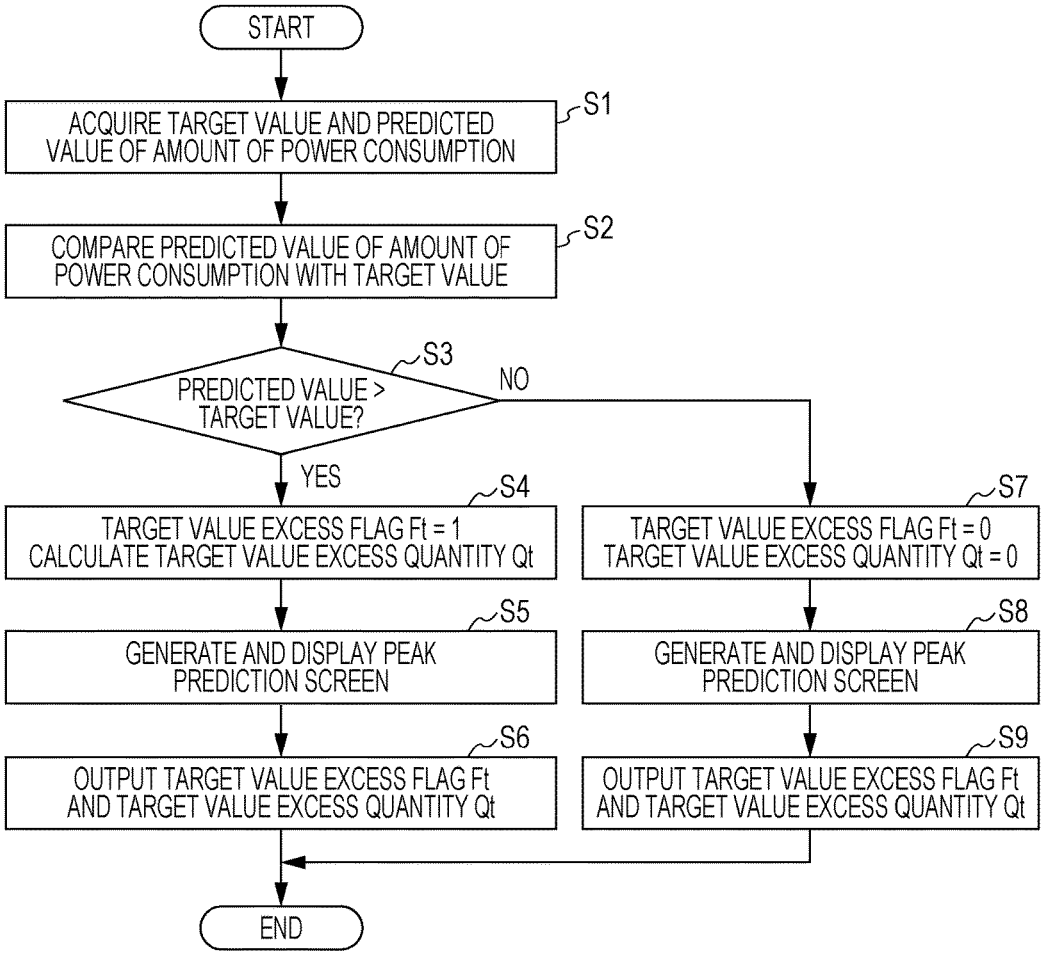
FIG. 7 is a flow chart for explaining an operation of an excess determiner.

FIG. 7 is a flow chart for explaining an operation of the excess determiner 54. First, the excess determiner 54 acquires, from the information terminal 1, a target value for the next 24 hours from the current time, and acquires, from the second power predictor 53, predicted values of the amount of power consumption during each second unit time (e.g., thirty minutes) (step S1).

Next, the excess determiner 54 compares the predicated values of the amount of power consumption during each second unit period of time for the next second predetermined period of time (e.g., 24 hours) with the target value (step S2). If, as a result of the comparison, the predicted values for the next 24 hours include a predicted value that exceeds the target value, the flow proceeds to step S4 as shown in step S3, and if not so, the flow proceeds to step S7.

If there is a predicted value that exceeds the target value, the excess determiner 54 sets a target value excess flag Ft to 1 and calculates a target value excess quantity Qt (step S4). Note here that the target value excess flag Ft is a flag that indicates whether a predicted value exceeds the target value. If the predicted value exceeds the target value, the target value excess flag Ft is set so that Ft=1, and if not so, the target value excess flag Ft is set so that Ft=0. Further, the target value excess quantity Qt [kW] is given as Qt=Pt−X, where X [kW] is the target value and Pt [kW] is the predicted value of the amount of power consumption during each second unit period of time.

Figure 8:
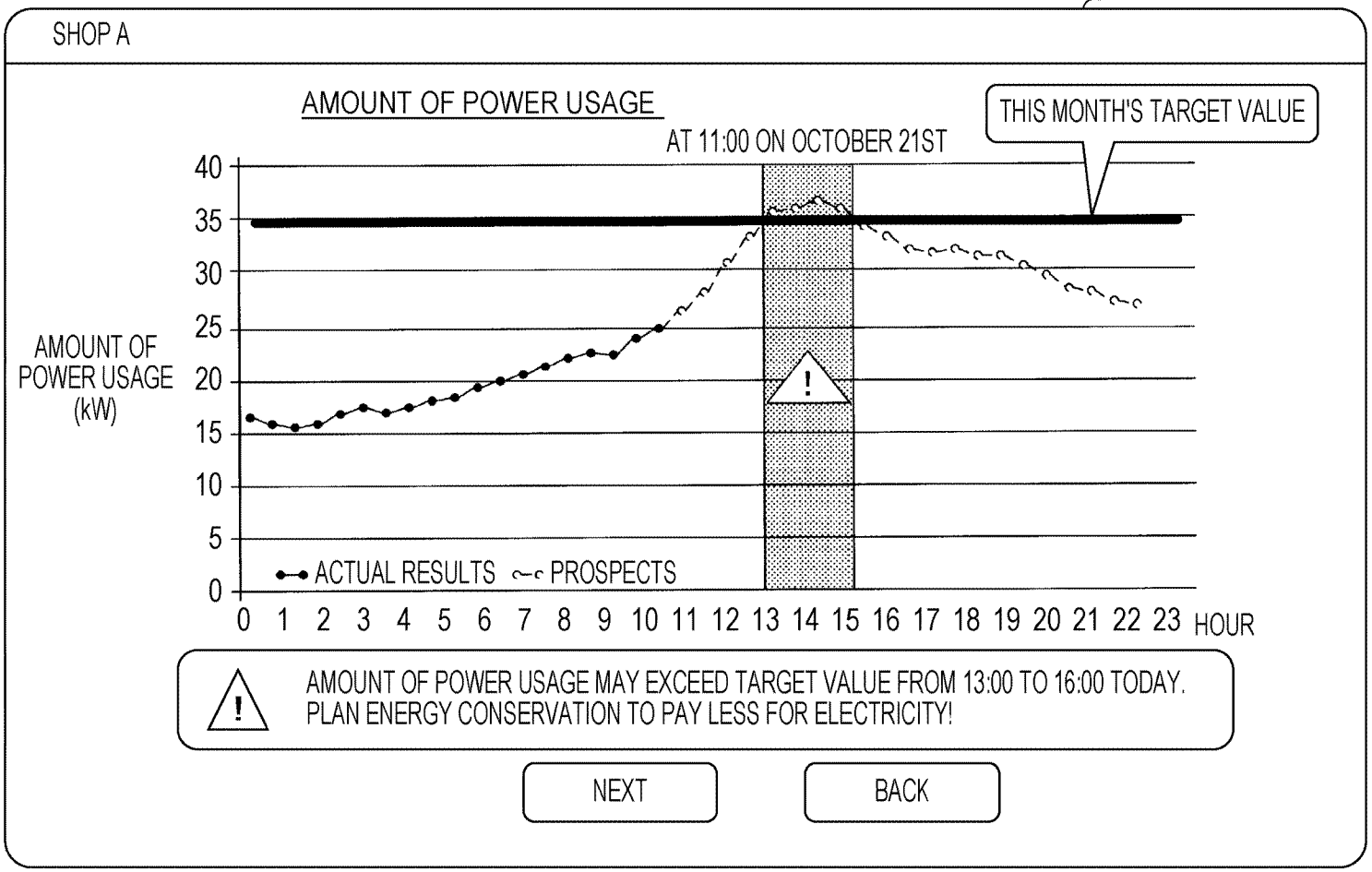
FIG. 8 is a diagram showing an example of a peak power display screen.

Next, the excess determiner 54 generates, on the basis of the information regarding the predicted values of the amount of power consumption during the second predetermined period of time as acquired from the second power predictor 53, a peak power display screen for displaying a time shift in the predicted values of the amount of power consumption of the day, transmits the peak power display screen to the information terminal 1. The controller 13 causes the display 12 of the information terminal 1 to display the peak power display screen (step S5). FIG. 8 is a diagram showing an example of a peak power display screen.

The peak power display screen SC3 shown in FIG. 8 contains a graph that represents changes over time in actual and predicted values of the amount of power usage (amount of power consumption) in the shop A in a day and the like. Further, the graph displays a target value that has been set. Although the peak power display screen SC3 displays the predicted and target values of the peak power in graph form as an example, the display form of the predicted and target values of the peak power is not limited to a graph in the present disclosure.

Furthermore, at a point of time where a predicted value of the amount of power consumption in the shop is predicted to exceed the target value, the peak power display screen SC3 gives an alarm display (such as the mark "!") that allows a shop staff viewing the peak power display screen SC3 to spot an excess of the peak power over the target value at a glance. Then, as shown in the lower column of FIG. 8, a time period during which the amount of power consumption is predicted to exceed the target value is clearly indicated by sentences. This time period is a time period that includes the second unit period of time in which the amount of consumption in the shop reaches its peak. Such a display allows a shop staff having viewed the peak power display screen SC3 displayed on the information terminal 1 to grasp the predicted and target values of the peak power of the day and grasp the time period in which a peak excess is predicted to occur. The excess determiner 54 and the controller 13 are an example of the controller of the present disclosure. The controller of the present disclosure causes a display of an information terminal to display a time period during which the amount of power consumption in the shop is predicted to exceed the target value.

Then, the excess determiner 54 outputs the target value excess flag Ft and the target value excess quantity Qt to the peak suppression display 55 (step S6).

On the other hand, if no predicted value exceeds the target value, the excess determiner 54 sets the target value excess flag Ft and the target value excess quantity to 0 (step S7). Then, as in the case of a predicted value exceeding the target value, the excess determiner 54 generates a peak power display screen for displaying a time shift in the predicted values of the peak power of the day, transmits the peak power display screen to the information terminal 1, and causes the information terminal 1 to display the peak power display screen (step S8). However, unlike the peak power display screen SC3 described in association with step S5, the peak power display screen in step S8 neither displays a predicted value of the peak power that exceeds the target value nor gives an alarm display. The excess determiner 54 outputs the target value excess flag Ft and the target value excess quantity Qt to the peak suppression display 55 (step S9).

It should be noted that, in step S3 of determining whether the predicted value Pt [kW] exceeds the target value X [kW], it is possible to give a margin $\alpha$ with a prediction error taken into account and, if $Pt+\alpha>X$, proceed to step S4. The value of the margin $\alpha$ may vary, for example, according to time to the start of the time period.

[Peak Suppression Display Operation]

The peak suppression display 55 acquires the target value excess flag Ft and the target value excess quantity Qt from the excess determiner 54. Note here that if the target value excess flag Ft=1, i.e., if the predicted value exceeds the target value within the next 24 hours, the peak suppression display 55 generates a message display screen that is a screen containing a message that presents an energy-saving action that is an action to reduce the amount of power consumption in the time period during which the predicted value exceeds the target value. This allows the peak suppression display 55 to generate the message display screen before the time period during which the amount of power consumption is predicted to exceed the target value, transmit the message display screen to the information terminal 1. The controller 13 causes the display 12 of the information terminal 1 to display the message display screen. The peak suppression display 55 and the controller 13 are an example of the controller of the present disclosure. The controller of the present disclosure causes a display of an information terminal to display a message that presents an action to reduce the amount of power consumption in the time period.

It should be noted that the generation and display of the message display screen by the peak suppression display 55 are not limited to particular timings in the present disclosure. The message display screen may be generated and displayed on the information terminal 1 at regular timings, e.g., every thirty minutes, at which the second power predictor 53 updates a peak power prediction over the second predetermined period of time, or may be timings at which the excess determiner 54 outputs the target value excess flag Ft.

Alternatively, for example, the process of generating and displaying the message display screen may be performed more often in wintertime, during which the air temperature is relatively low, than in summertime, during which the air temperature is relatively high. That is, specifically, for example, the process of generating the message display screen may be performed once in a day in summertime, whereas the process of generating the message display screen may be performed a plurality of times in a day in wintertime. Alternatively, the process of generating the message display screen may be performed only during a period of time excluding at least summertime. An example of such a message display is a message or the like that recommends refraining from the use of or reducing the output from a device, such as a fryer, an oden pot, or a heat retainer, that heats merchandize.

Alternatively, on the other hand, the process of generating and displaying the message display screen may be performed more often in summertime, during which the air temperature is relatively high, than in wintertime, during which the air temperature is relatively low. That is, specifically, for example, the process of generating the message display screen may be performed once in a day in wintertime, whereas the process of generating the message display screen may be performed a plurality of times in a day in summertime. Alternatively, the process of generating the message display screen may be performed only during a period of time excluding at least wintertime. An example of such a message display is a message or the like that suggests reducing insolation with a blind or the like.

Figure 9:
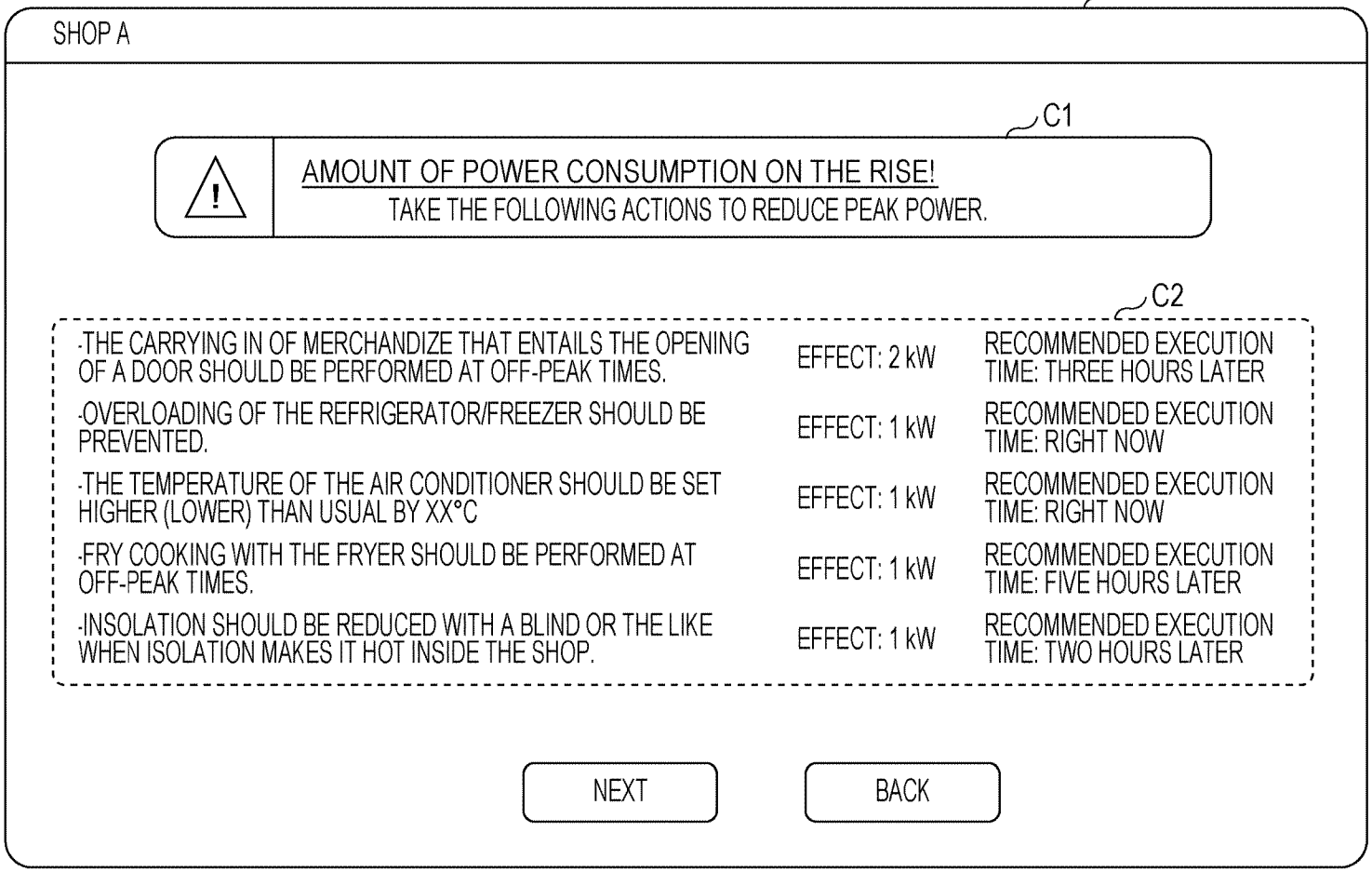
FIG. 9 is a diagram showing an example of a message display screen that presents energy-saving actions.

FIG. 9 is a diagram showing an example of a message display screen that presents energy-saving actions. As shown in FIG. 9, the message display screen SC4 includes a notice display column C1 and a message display column C2. The notice display column C1 is a column that displays a notice of warning that a predicted value of the amount of power consumption exceeds the target value. Further, the message display column C2 is a column that presents energy-saving actions that are effective in reducing the predicted value of the amount of power consumption and specific descriptions of the energy-saving actions.

As such, the message in the present disclosure is intended to present, to the shop staff, the energy-saving actions, which are actions to suppress the peak of the amount of power consumption. As shown in FIG. 9, the message display column C2 may display the effect of each energy-saving action in concrete figures (amount of power that is saved per hour). The amount of power that is saved by each energy-saving action needs only be stored, for example, in the database (not shown) of the server device 5. Further, each message may be presented with a time (recommended time) at which the energy-saving action is recommended to be executed. This time needs only be a time between the current time and the time at which the amount of power consumption exceeds the target value or be determined according to the nature of the energy-saving action.

Although, in FIG. 9, six messages are displayed in the message display column C2, the number of messages that the peak suppression display 55 displays in the message display column C2 is not limited to this number. For example, the peak suppression display 55 may display all messages that are effective for the shop, or may display a predetermined number of messages extracted from among the effective messages.

The types of energy-saving actions are not limited to the examples shown in FIG. 9, and possible examples include various energy-saving actions shown in FIG. 10. As for the energy-saving actions, it is desirable that energy-saving actions that are effective for each shop be set in advance, for example, according to the location of the shop or the functions or numbers of facilities (such as refrigerating and freezing facilities and air-conditioning facilities) possessed by the shop. FIG. 10 is a table showing examples of messages including items of energy-saving action and specific descriptions of the energy-saving actions. The items of energy-saving action give an overview of the energy-saving actions.

It should be noted that the energy-saving actions to reduce the peak of the amount of power consumption include actions to reduce the amount of power consumption in the time period during which the amount of power consumption is predicted to exceed the target value and actions to suppress an activity that leads to an increase in the amount of power consumption. Specific examples of the actions to reduce the amount of power consumption includes actions described as energy-saving actions "proper temperature of air conditioner", "turning off of backroom and warehouse lighting and air conditioner", "prevention of insolation", "sprinkling of water over area around outdoor unit", "turning on and turning off of light control", "lid closure of oden pot", "turning off of anti-sweat heater", "air supply and exhaust opening ventilation of showcase", "load-line securement of showcase" "use of night cover over showcase", "screening of outdoor unit from the sun", etc. in FIG. 10. Further, examples of the actions to suppress an activity that leads to an increase in the amount of power consumption includes actions described as energy-saving actions "shortening of time during which WI (walk-in) door is open", "shortening of time during which refrigerator/freezer door is open", "fryer operation", etc. in FIG. 10. It should be noted that these energy-saving actions are mere examples and are not intended to limit the scope of energy-saving actions of the present disclosure.

Further, it is desirable that, as shown in FIG. 10, the peak suppression display 55 give different descriptions of the energy-saving actions according to the grace period from the current time to the time at which the predicted value of the amount of power consumption exceeds the target value. That is, an action presented by a description that is displayed when the grace period is relatively long (e.g., "three hours or more before target value is exceeded" shown in FIG. 10) needs only be an energy-saving action that requires longer time to reach a maximum reduction in the amount of power consumption than an action presented by a description that is displayed when the grace period is relatively short (e.g., "less than thirty minutes before target value is exceeded" shown in FIG. 10). Specific examples are as follows: For example, as shown in FIG. 10, in a case where the grace period is relatively long, i.e., in the case of three hours or more before a peak excess, the description "the carrying in of merchandize that entails the opening of a door should be performed at off-peak times" is given as a description that corresponds to the energy-saving action "shortening of time during which WI (walk-in) door is open"; meanwhile, in a case where the grace period is relatively short, i.e., in the case of less than thirty minutes before the target value is exceeded, the description is "the carrying in of merchandize that entails the opening of a door should be suspended for the time being".

In a case where the grace period is relatively short, an action that is effective in reducing the amount of power consumption more immediately may be presented than in a case where the grace period is relatively long. In this case, as mentioned above, such an energy-saving action that there is no peak excess even in a case where the grace period is relatively short can be presented by using a message to present an action, albeit the same as the energy-saving action, that is effective more immediately than in a case where the grave period is relatively long.

Further, in a case where the grace period is relatively short, an action that reduces the amount of power consumption more may be presented than in a case where the grace period is relatively long. In this case, as mentioned above, such an energy-saving action that the target value is not exceeded even in a case where the grace period is relatively short can be presented by using a message to present an action, albeit the same as the energy-saving action, that is effective more immediately than in a case where the grave period is relatively long.

Specifically, as shown in FIG. 10, in a case where the grace period is relatively long, i.e., in the case of three hours or more before the target value is exceeded, the description "the temperature of the air conditioner should be set higher (lower) than usual by XX° C." is given as a description that corresponds to the energy-saving action "proper temperature of air conditioner". Meanwhile, in a case where the grace period is relatively short, i.e., in the case of less than thirty minutes before the target value is exceeded, the description is "the temperature of the air conditioner should be set further higher (lower) by YY° C.".

Further, in a case where the grace period is relatively long, a message that presents an energy-saving action may be presented, and in a case where the grace period is relatively short, no message that presents an energy-saving action may be displayed. In this case, in the time period during the target value is predicted to be exceeded, the execution of an energy-saving action that is not desired to be executed can be reduced.

For example, as shown in FIG. 10, in a case where the grace period is relatively long, i.e., in the case of thirty minutes or more before the target value is exceeded, the description "the ventilation fan should be turned off to reduce the amount of inflow of outside air to reduce the amount of power that is consumed by the air conditioner" as a description that corresponds to the energy-saving action "turning off of in-shop ventilation fan". Meanwhile, in a case where the grace period is relatively short, i.e., in the case of less than thirty minutes before the target value is exceeded, no such description is displayed. This is because executing an energy-saving action (e.g., "turning off of in-shop ventilation fan") when the grace period is relatively short may impair comfortability to create impatience in the shop staff in the peak time period and thus tempts him/her to execute an action that leads to an increase in the amount of power consumption (e.g., long-term continuation of the turning on of the in-shop ventilation).

For another example, as shown in FIG. 10, in a case where the grace period is relatively long, i.e., in the case of three hours or more before the target value is exceeded, the description "overloading should be prevented by organizing the contents of the refrigerator/freezer, e.g., by keeping those which are not used immediately in the freezer chest" as a description that corresponds to the energy-saving action "organization of contents of refrigerator/freezer". Meanwhile, in a case where the grace period is relatively short, i.e., in the case of less than three hours before the target value is exceeded, no such description is displayed. This is because executing such a time-consuming energy-saving action (e.g., "organization of contents of refrigerator/freezer") when the grace period is relatively short may affect in-shop operations in a period overlapped with a busy period of in-shop business hours. It should be noted that the peak time period tends to be overlapped with a busy time period of in-shop business hours.

For another example, as shown in FIG. 10, in a case where the grace period is relatively long, i.e., in the case of thirty minutes or more before the target value is exceeded, the description "insolation should be reduced with a blinder or the like when isolation makes it hot inside the shop" as a description that corresponds to the energy-saving action "prevention of insolation". Meanwhile, in a case where the grace period is relatively short, i.e., in the case of less than thirty minutes before the target value is exceeded, no such description is displayed. This is because, in the case of an energy-saving action (e.g., "prevention of insolation") that requires time to express an energy-saving effect, executing such an action when the grace period is relatively short may not bring about an energy-saving effect in the peak time period.

It should be noted that, as for a predetermined energy-saving action, a message that presents the energy-saving action may be presented in a case where the grace period is relatively long, and no message that presents an energy-saving action may be displayed in a case where the grace period is relatively short, but as for another energy-saving action that is different from the predetermined energy-saving action, a message that presents the energy-saving action may be presented also in a case where the grace period is relatively short. For example, as shown in FIG. 10, as for the energy-saving action "prevention of insolation", no message that presents the energy-saving action is displayed, and when there is less than thirty minutes before the target value is exceeded, as for the energy-saving action "fryer operation", a message that present the energy-saving action may be displayed even when there is less than thirty minutes before the target value is exceeded.

Furthermore, the peak suppression display 55 may display different energy-saving actions according to the excess quantity Qt by which the predicted value of the peak power exceeds the target value. Specifically, on the basis of the amount of power that is saved by each energy-saving action, the peak suppression display 55 extracts a combination of energy-saving actions by which the total amount of power that is saved exceeds the excess quantity Qt and the number of energy-saving actions is smallest. Moreover, the peak suppression display 55 presents the combination of energy-saving actions thus extracted, thus making it possible to efficiently reduce the peak power.

Furthermore, the peak suppression display 55 may present a particular energy-saving action according to whether the air temperature in the shop is high or low. Specifically, as shown in FIG. 10, the energy-saving action "prevention of insolation" is presented only in a case where the air temperature in the shop is a predetermined temperature, i.e., in summertime. Alternatively, the energy-saving action "turning off of anti-sweat heater" is presented only in a case where the air temperature in the shop is equal to or lower than a predetermined temperature, i.e., in wintertime. This makes it possible to present energy-saving actions as appropriate according to the situation in which the shop is. It should be noted that, as information regarding the air temperature in the shop, information regarding temperature and humidity measured by the temperature and humidity sensor 41 of the shop needs only be utilized. Further, the above-described aspect of presentation only during a particular period of time (e.g., summertime or wintertime) according to whether the air temperature is high or low does not imply any limitation. The peak suppression display 55 may present a particular energy-saving action more often in a particular period of time (e.g., summertime) than in another period of time (e.g., wintertime).

Figure 11:
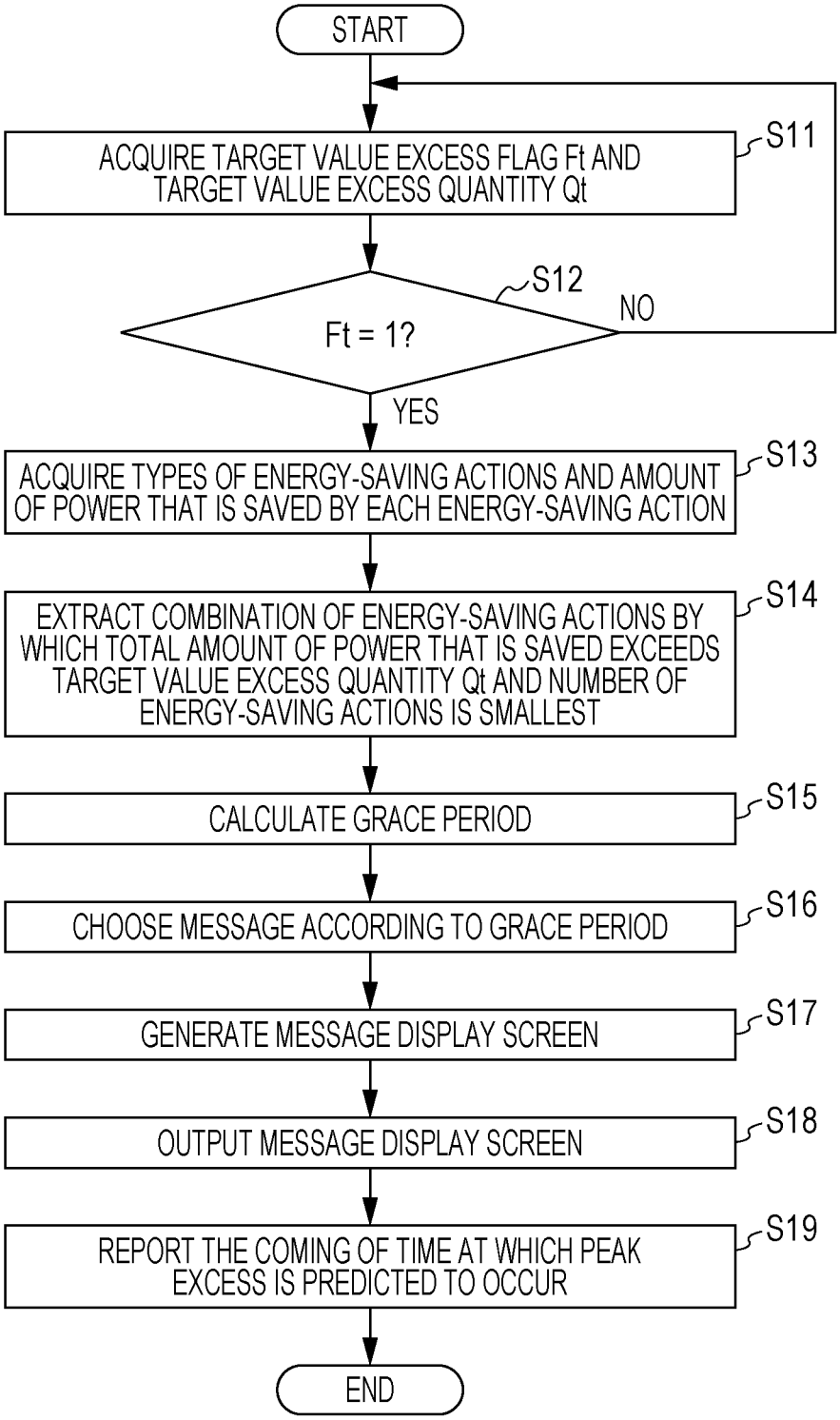
FIG. 11 is a flow chart for explaining a peak suppression operation that is performed by a peak suppression display.

FIG. 11 is a flow chart for explaining a peak suppression operation that is performed by the peak suppression display 55. First, the peak suppression display 55 acquires a target value excess flag Ft and a target value excess quantity Qt from the excess determiner 54 (step S11).

Next, the peak suppression display 55 determines whether the target value excess flag Ft is 1, i.e., whether the predicted values of the peak power during every thirty minutes for the next 24 hours include a predicted value that exceeds the target value (step S12). If, in step S12, Ft=1, the flow proceeds to step S13, and if not so, the flow returns to step S11.

The peak suppression display 55 acquires, for example from the database (not illustrated) of the server device 5, types of energy-saving actions that can be performed in the shop and the amount of power that is saved by each energy-saving action (step S13). Then, the peak suppression display 55 extracts a combination of energy-saving actions by which the total amount of power that is saved exceeds the target value excess quantity Qt and the number of energy-saving actions is smallest (step S14).

Furthermore, the peak suppression display 55 calculates a grace period from the current time to the time at which the predicted value of the amount of power consumption exceeds the target value (step S15). Then, for each energy-saving action extracted in step S14, the peak suppression display 55 chooses a message according to the grace period as exemplified in FIG. 10 (step S16). The peak suppression display 55 generates a message display screen such as that illustrated in FIG. 9 on the basis of the energy-saving actions extracted in step S14 and the messages chosen in step S16 (step S17), and outputs the message display screen to the information terminal 1 (step S18). Then, when the time has come at which the predicted value of the amount of power consumption exceeds the target value, the peak suppression display 55 causes the information terminal 1 to display a screen that reports accordingly (step S19). The screen may display a notification of whether the amount of power consumption (peak power) was successfully made equal to or smaller than the target value by the action(s) of a shop staff who referred to the message(s), as well as the coming of the time at which the amount of power consumption was predicted to exceed the target value.

Thus, according to the amount by which the predicted value of the amount of power consumption exceeded or the grace period from the current time to the time at which the amount of power consumption exceeds the target value, the peak suppression display 55 appropriately selects energy-saving actions or messages that are to be presented. This makes it possible to efficiently reduce the peak power.

[Example Operation of the Entire Energy Conservation Support System 200]

Figure 12:
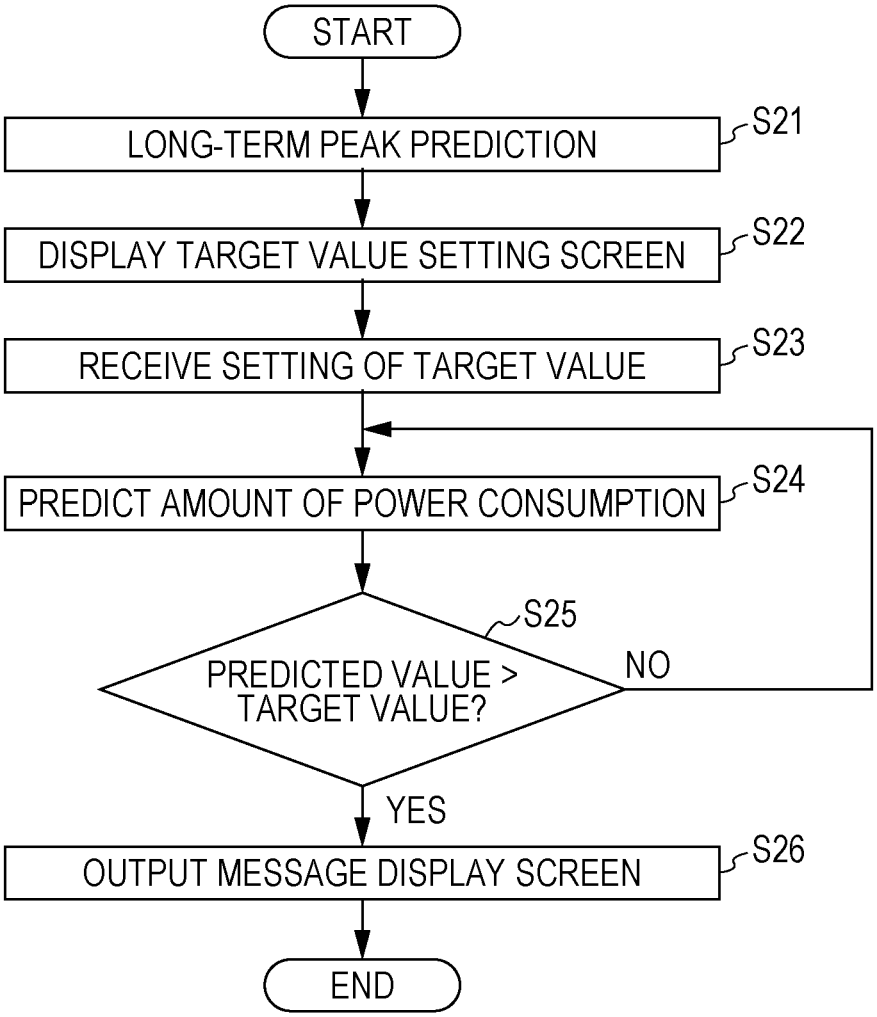
FIG. 12 is a flow chart for explaining an example operation of the entire energy conservation support system.

Finally, an example operation of the entire energy conservation support system 200 is described. FIG. 12 is a flow chart for explaining an example operation of the entire energy conservation support system 200. It should be noted that the detailed contents of operation in each step have been described above and, as such, are not described here.

First, the first power predictor 51 predicts peak power in a shop during each first unit period of time (e.g., one month) over a long-term first predetermined period of time (e.g., several months) (step S21). For example, a trigger for the first power predictor 51 to make a long-term peak power prediction needs only be the reception of an instruction for a long-term prediction from the shop via the information terminal 1, the coming of a predetermined time, e.g., 12:00 a.m. of the first day of a month, or the like.

The target value setting display 52 generates information regarding a target value setting screen on the basis of the prediction of the peak power over the long-term first predetermined period of time as executed in step S21, and transmits the information to the information terminal 1. The controller 13 causes the display 12 to display the target value setting screen on the basis of the information regarding the target value setting screen (step S22). Then, the receptor 11 receives the setting of a target value by a shop staff of the shop to the receptor 11 of the information terminal 1 (step S23). The controller 13 outputs, to the excess determiner 54, the target value set via the communication device of the information terminal 1, and the second power predictor 53 predicts the amount of power consumption during each second unit period of time (e.g., thirty minutes) over a short-term second predetermined period of time (e.g., one day) (step S24).

The excess determiner 54 compares the predicted value of the amount of power consumption predicted in step S24 with the target value set in step S23. If, as a result of the comparison, the predicted value exceeds the target value, the flow proceeds to step S26, and if not so, the flow returns to step S24 (step S25). The peak suppression display 55 generates information regarding a message display screen according to the predicted value, the target value, and the time to peak excess, and outputs the information (step S26). The generation of information regarding a message display screen by the peak suppression display 55 needs only be performed every thirty minutes a predicted value is acquired.

As described above, an information terminal control method according to a first aspect of the present disclosure includes: (a) predicting whether an amount of power consumption in a shop exceeds a target value; (b) when the amount of power consumption in the shop is predicted to exceed the target value, causing a display of an information terminal to display a screen displaying a time period during which the amount of power consumption in the shop is predicted to exceed the target value; and (c) causing the display to display a screen displaying a message that presents an action to reduce the amount of power consumption in the time period.

That is, the energy conservation support system 200 compares a predicted value of the amount of power consumption in the shop with the target value and, in a case where the predicted value exceeds the target value, reports the time period during which the amount of power consumption in the shop is predicted to exceed the target value. Further, the energy conservation support system 200 displays a message that presents an action to reduce the amount of power consumption in the shop in the time period. By a shop staff referring to this message and executing the action to reduce the amount of power consumption, the amount of power consumption in the shop in the time period is reduced. This makes it possible to reduce the possibility that the amount of power consumption in the shop may exceed the target value. This in turn makes it possible to improve efficiency in energy conservation.

Note here that the "amount of power consumption" may be an integrated value of instantaneous values of the amount of power consumption during the second unit period of time, or may be an instantaneous maximum value of the amount of power consumption during the second unit period of time. The second unit period of time may be a period of time that is shorter than 24 hours, e.g., 0.5 hour.

Further, the amount of power consumption in the shop may be a total value of the amount of power that is consumed by all power-consuming apparatuses installed in the shop, or may be a total value of the amount of power that is consumed by one or some of the power-consuming apparatuses installed in the shop. That is, the amount of power consumption in the shop needs only be a total value of the amount of power that is consumed by at least one or some of all of the power-consuming apparatuses installed in the shop.

Further, an information terminal control method according to a second aspect of the present disclosure is the information terminal control method according to the first aspect, wherein the action to reduce the amount of power consumption includes an action to suppress an activity of a shop staff that leads to an increase in the amount of power consumption in the time period during which the amount of power consumption is predicted to exceed the target value. This causes a message to be presented such that not only the action to reduce the amount of power consumption but also an action that cannot reduce the amount of power consumption are performed at different execution times. This makes it possible to more efficiently reduce the peak power.

Further, an information terminal control method according to a third aspect of the present disclosure is the information terminal control method according to the first aspect, wherein the step (c) is executed at regular intervals, e.g., every thirty minutes. This makes it possible to display, at an appropriate timing, a message that presents an action to suppress a peak of the amount of power consumption.

Further, an information terminal control method according to a fourth aspect of the present disclosure is the information terminal control method according to any one of the first to third aspects, wherein the step (c) is executed before the time period during which the amount of power consumption is predicted to exceed the target value. This reduces the possibility that the amount of power consumption may exceed the targeted amount of power, thus improving efficiency in power conservation.

Further, an information terminal control method according to a fifth aspect of the present disclosure is the information terminal control method according to any one of the first, third, and fourth aspects, wherein the message includes a recommended time for the shop staff to execute the action. This allows the shop staff to recognize when to execute an energy-saving action or when not to execute an activity that leads to an increase in the amount of power consumption, thus making it possible to efficiently reduce the peak power.

Further, an information terminal control method according to a sixth aspect of the present disclosure is the information terminal control method according to the second aspect, wherein the message includes a recommended time for the shop staff to execute the activity. This allows the shop staff to, before the time period during which the amount of power consumption in the shop is predicted to exceed the target value, recognize when to execute the activity that leads to an increase in the amount of power consumption, thus making it possible to efficiently reduce the peak power.

Further, an information terminal control method according to a seventh aspect of the present disclosure is the information terminal control method according to any one of the first to sixth aspects, wherein the message includes an amount of reduction in the amount of power consumption that is achieved by executing the action. This allows the shop staff to, before taking an action, recognize which energy-saving action can efficiently reduce the peak power, thus making it possible to efficiently reduce the peak power.

Further, an information terminal control method according to an eighth aspect of the present disclosure is the information terminal control method according to the first aspect, wherein a content of the message that is displayed on the screen is changed according to a grace period before the time period during which the amount of power consumption is predicted to exceed the target value.

Further, an information terminal control method according to a ninth aspect of the present disclosure is the information terminal control method according to the eighth aspect, wherein the energy-saving action presented by the message that is displayed on the screen when the grace period is a first period is an action that requires longer time to reach a maximum reduction in the amount of power consumption than the action presented by the message that is displayed on the screen when the grace period is a second period that is shorter than the first period. For this reason, even when the energy-saving action requires long time to reach a maximum reduction in the amount of power consumption, the effect of reduction in the amount of power consumption is less likely to be brought about after the time period during which the target value is predicted to be exceeded. That is, the effect of reduction in the amount of power consumption by the energy-saving action is more likely to contribute to the reduction in the peak power.

Further, an information terminal control method according to a tenth aspect of the present disclosure is the information terminal control method according to the eighth aspect, wherein the action in the message that is displayed on the screen when the grace period is a first period is an action that leads to a larger amount of reduction in the amount of power consumption than the action in the message that is displayed on the screen when the grace period is a second period that is longer than the first period. For this reason, even when the grace period is the second period, which is relatively short, such an energy-saving action can be presented that the amount of power consumption does not exceed the target value.

Further, an information terminal control method according to an eleventh aspect of the present disclosure is the information terminal control method according to the eighth aspect, wherein the message is displayed on the screen when the grace period is a second period that is longer than a first period and the message is not displayed when the grace period is the first period. For this reason, in the time period during the target value is predicted to be exceeded, the execution of an energy-saving action that is not desired to be executed can be reduced.

Further, an information terminal control method according to a twelfth aspect of the present disclosure is the information terminal control method according to the second aspect, wherein the activity is at least either carrying in or replenishing of merchandize into a refrigerating showcase by the shop staff.

Further, an information terminal control method according to a thirteenth aspect of the present disclosure is the information terminal control method according to the second aspect, wherein the activity is at least either carrying in or replenishing of merchandize into a freezing showcase by the shop staff.

Further, an information terminal control method according to a fourteenth aspect of the present disclosure is the information terminal control method according to the second aspect, wherein the activity is an activity regarding food heating.

Further, an information terminal control method according to a fifteenth aspect of the present disclosure is the information terminal control method according to the thirteenth aspect, wherein the step (c) is executed more often in a period of time during which air temperature is a second temperature that is lower than a first temperature than in a period of time during which the air temperature is the first temperature. This makes it possible to, for example in wintertime, display a message or the like that recommends refraining from the use of or reducing the output from a device, such as a fryer, an oden pot, or a heat retainer, that heats merchandize.

Further, an information terminal control method according to a sixteenth aspect of the present disclosure is the information terminal control method according to any one of the first and third to ninth aspects, wherein the action is an operation of lowering an amount of power that is consumed by at least either an air-conditioning facility or a lighting facility.

Further, an information terminal control method according to a seventeenth aspect of the present disclosure is the information terminal control method according to the sixteenth aspect, wherein the operation is an operation of powering off at least either a particular air-conditioning facility or a particular lighting facility.

Further, an information terminal control method according to an eighteenth aspect of the present disclosure is the information terminal control method according to any one of the first and third to ninth aspects, wherein the action is at least either an action that leads to a reduction in amount of insolation to the shop or an action of sprinkling water in premises of the shop.

Further, an information terminal control method according to a nineteenth aspect of the present disclosure is the information terminal control method according to the eighteenth aspect, wherein the step (c) is executed more often in a period of time during which air temperature is a fourth temperature that is higher than a third temperature than in a period of time during which the air temperature is the third temperature. This makes it possible to, for example in summertime, display a message or the like that suggests reducing insolation with a blind or the like.

Further, an information terminal control method according to a twentieth aspect of the present disclosure is the information terminal control method according to any one of the first to nineteenth aspects, further including the step of (d) displaying, on the display, an screen that reports that the time period has come during which the amount of power consumption is predicted to exceed the target value.

Further, an information terminal control method according to a twenty-first aspect of the present disclosure is the information terminal control method according to any one of the first to seventeenth aspects, further including: (e) displaying, on the screen, a peak value of an amount of power consumption in the shop during each month; and (f) while the step (e) is being executed, receiving input of the target value by an operator. This makes it possible to appropriately set the target value.

Further, an energy conservation support system according to a twenty-second aspect of the present disclosure includes: a predictor that predicts whether an amount of power consumption in a shop exceeds a target value; and a controller that, when the amount of power consumption in the shop is predicted to exceed the target value, causes a display of an information terminal to display a screen displaying a time period during which the amount of power consumption in the shop is predicted to exceed the target value and that displays a screen displaying a message that presents an action to reduce the amount of power consumption in the time period.

By a shop staff referring to this message and executing the action to suppress the peak of the amount of power consumption, the peak of the amount of power consumption is suppressed. This makes it possible to reduce the possibility that the amount of power consumption in the shop may exceed the target value. This in turn improves efficiency in energy conservation.

In the foregoing, the embodiment of the present disclosure has been described in detail with reference to the drawings. The functions of the devices such as the information terminal 1 and the server device 5 may be achieved by a computer program.

Figure 13:
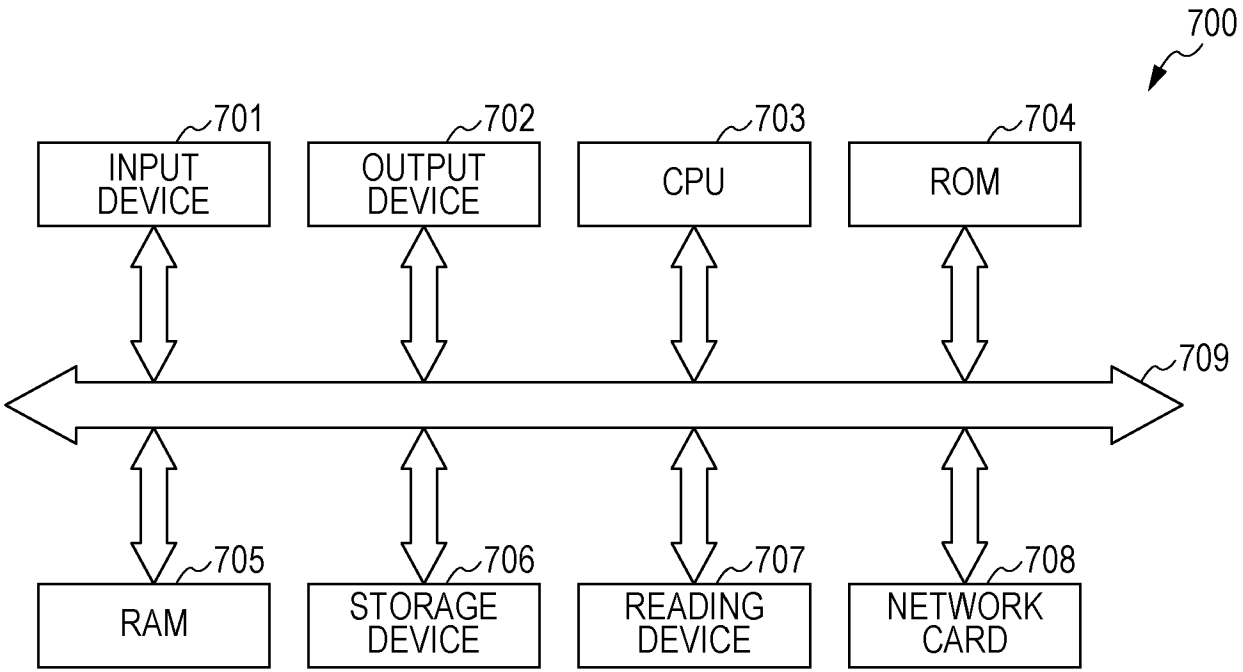
FIG. 13 is a diagram showing a hardware configuration of a computer that programmatically achieves a function of each device.

FIG. 13 is a diagram showing a hardware configuration of a computer 700 that programmatically achieves a function of each device.

For example, the computer 700 includes an input device 701 such as a keyboard, a mouse, or a touch pad, an output device 702 such as a display or a speaker, a CPU 703, a ROM (read-only memory) 704, a RAM (random access memory) 705, a storage device 706 such as a hard disk device or an SSD (solid state drive), a reading device 707 that reads information from a storage medium such as a DVD-ROM (digital versatile disk read-only memory) or a USB (universal serial bus) memory, a network card 708 that performs communication via a network, and the like, and these components are connected to one another via a bus 709.

Moreover, from a storage medium storing a program for achieving the function of each of the devices, the reading device 707 reads the program, and stores the program thus read in the storage device 706. Alternatively, the network card 708 performs communication with a server device connected to the network, downloads, from the server device, a program for achieving the function of each of the devices, and stores the program in the storage device 706.

Then, the CPU 703 copies, into the RAM 705, the program stored in the storage device 706, sequentially reads out commends contained in the program from the RAM 705, executes the commands, and thereby achieves the function of each of the devices.

Further, the technology described in the above embodiment may be achieved in any of the following types of cloud service. Note, however, that the type in which the technology described in the above embodiment is achieved is not limited to these types.

(Type 1 of Service: Company's Own Data Center Type)

Figure 14:
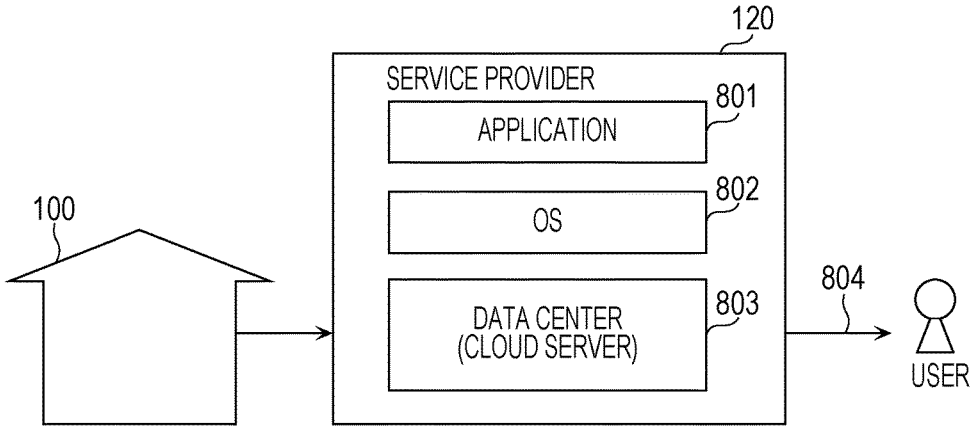
FIG. 14 is a diagram showing a type 1 of service (company's own data center type)

FIG. 14 is a diagram showing a type 1 of service (company's own data center type). The type 1 is a type in which the service provider 120 acquires information from the group 100 and provides a service to the user. In the type 1, the service provider 120 functions as a data center operating company. That is, the service provider 120 possesses the cloud server 111, which manages big data. Therefore, no data center operating company 110 exists.

In the type 1, the service provider 120 operates and manages a data center 803 (cloud server 111). Further, the service provider 120 manages an OS 802 and an application 801. The service provider 120 performs service provisioning 804 with the OS 802 and the application 801 managed by the service provider 120.

(Type 2 of Service: IaaS-Based Type)

Figure 15:
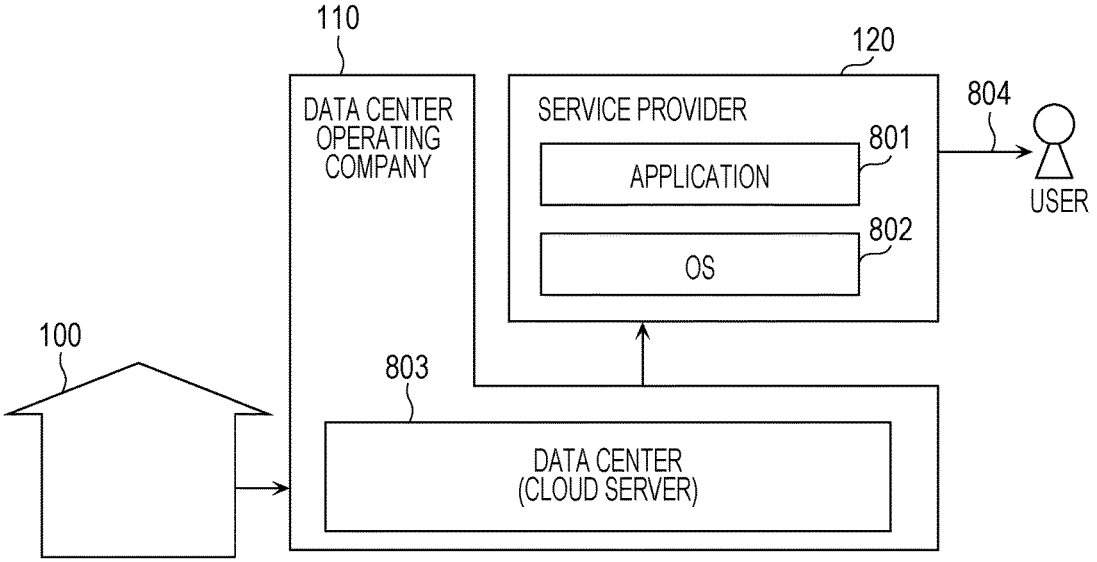
FIG. 15 is a diagram showing a type 2 of service (IaaS-based type)

FIG. 15 is a diagram showing a type 2 of service (IaaS-based type). The term "IaaS" here is the abbreviation of "infrastructure as a service", and means a cloud service providing model in which an infrastructure for building and operating a computer system per se is provided as a service via the Internet.

In the type 2, the data center operating company 110 operates and manages a data center 803 (cloud server 111). Further, the service provider 120 manages an OS 802 and an application 801. The service provider 120 performs service provisioning 804 with the OS 802 and the application 801 managed by the service provider 120.

(Type 3 of Service: PaaS-Based Type)

Figure 16:
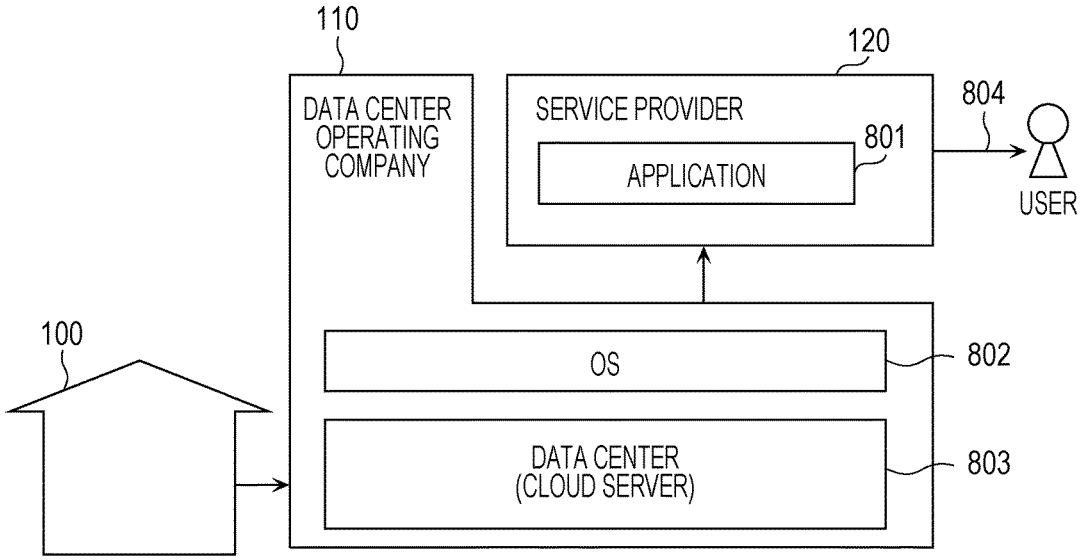
FIG. 16 is a diagram showing a type 3 of service (PaaS-based type)

FIG. 16 is a diagram showing a type 3 of service (PaaS-based type). The term "PaaS" here is the abbreviation of "platform as a service", and means a cloud service providing model in which a platform serving as a basis for building and operating software is provided as a service via the Internet.

In the type 3, the data center operating company 110 manages an OS 802 and operates and manages a data center 803 (cloud server 111). Further, the service provider 120 manages an application 801. The service provider 120 performs service provisioning 804 with the OS 802 managed by the data center operating company 110 and the application 801 managed by the service provider 120.

(Type 4 of Service: SaaS-Based Type)

Figure 17:
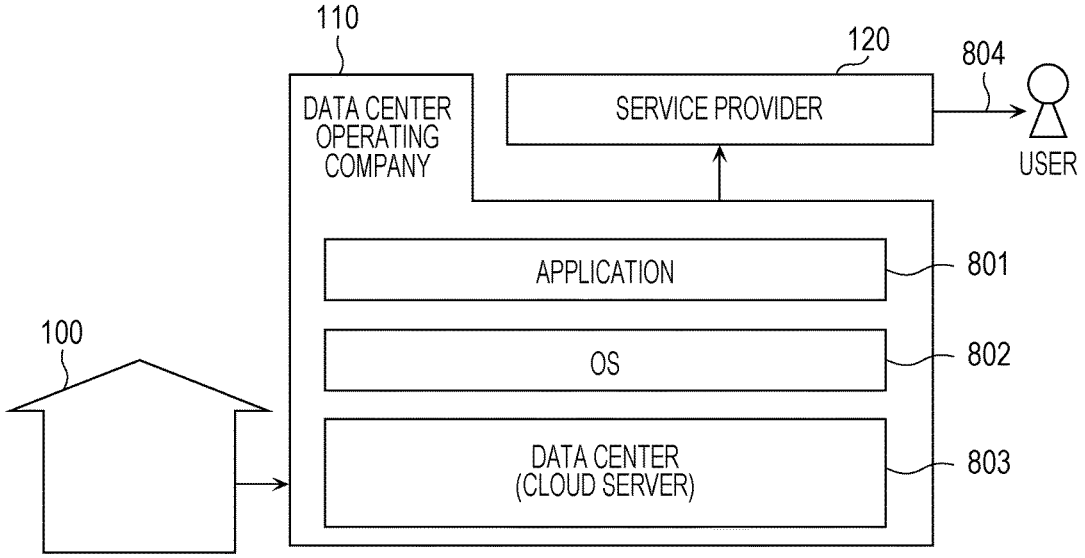
FIG. 17 is a diagram showing a type 4 of service (SaaS-based type).

FIG. 17 is a diagram showing a type 4 of service (SaaS-based type). The term "SaaS" here is the abbreviation of "software as a service". For example, the term "SaaS" means a cloud service providing model including a function that allows a company or individual (user) who does not possess a data center (cloud server) to use, via a network such as the Internet, an application provided by a platform provider who possesses a data center (cloud server).

In the type 4, the data center operating company 110 manages an application 801, manages an OS 802, and operates and manages a data center 803 (cloud server 111). Further, the service provider 120 performs service provisioning 804 with the OS 802 and the application 801 managed by the data center operating company 110.

In any of the foregoing types, the service provider 120 performs service providing actions. Further, for example, the service provider 120 or the data center operating company 110 may develop an OS, an application, or a database of big data by itself or may outsource the development to a third party.

The present disclosure is suitable to an information terminal control method for supporting energy conservation in a plurality of shops by causing information terminals provided in the shops to display a message that presents an action to reduce the amount of power consumption.

What is claimed is:

1. An information terminal control method performed by a processor of an information terminal executing instructions stored in a memory, the method comprising:

predicting an amount of power consumption in an area in each period of a plurality of periods;

determining whether the predicted amount of power consumption in each period of the plurality of periods exceeds a target value of the power consumption in each period of the plurality of periods;

when there is a first period, of the plurality of periods, in which the predicted amount of power consumption is determined to exceed the target value, causing a display of the information terminal to display a first screen including a time-sequence diagram of the plurality of periods, in which the first period is displayed distinctively from a second period of the plurality of periods, where the predicted amount of power consumption in the second period is determined not to exceed the target value; and causing the display to display a second screen including a message that presents an action to be performed in the second period to reduce the amount of power consumption in the first period to be less than the target value, wherein a content of the message displayed on the display is changed according to a grace period before the first period starts, and wherein the action in the message that is displayed when the grace period is a first grace period requires longer time to reach a maximum reduction in the amount of power consumption than the action in the message that is displayed when the grace period is a second grace period that is shorter than the first grace period.

2. The information terminal control method according to claim 1, wherein the message further presents an action that leads to an increase in the amount of power consumption in the first period, and is to be suppressed during the first period.

3. The information terminal control method according to claim 1, wherein the message is displayed at regular intervals.

4. The information terminal control method according to claim 1, wherein the message is displayed before the first period.

5. The information terminal control method according to claim 1, wherein the message includes a recommended time to perform the action.

6. The information terminal control method according to claim 2, wherein the message includes a recommended time to perform the action to be suppressed in the first period.

7. The information terminal control method according to claim 1, wherein the message includes an amount of reduction in the amount of power consumption that is achieved by performing the action.

8. An information terminal control method performed by a processor of an information terminal executing instructions stored in a memory, the method comprising:

predicting an amount of power consumption in an area in each period of a plurality of periods;

determining whether the predicted amount of power consumption in each period of the plurality of periods exceeds a target value of the power consumption in each period of the plurality of periods;

when there is a first period, of the plurality of periods, in which the predicted amount of power consumption is determined to exceed the target value, causing a display of the information terminal to display a first screen including a time-sequence diagram of the plurality of periods, in which the first period is displayed distinctively from a second period of the plurality of periods, where the predicted amount of power consumption in the second period is determined not to exceed the target value; and causing the display to display a second screen including a message that presents an action to be performed in the second period to reduce the amount of power consumption in the first period to be less than the target value, wherein a content of the message displayed on the display is changed according to a grace period before the first period starts, and wherein the action in the message that is displayed when the grace period is a first grace period leads to a larger amount of reduction in the amount of power consumption than the action in the message that is displayed when the grace period is a second grace period that is longer than the first grace period.

9. An information terminal control method performed by a processor of an information terminal executing instructions stored in a memory, the method comprising:

predicting an amount of power consumption in an area in each period of a plurality of periods;

determining whether the predicted amount of power consumption in each period of the plurality of periods exceeds a target value of the power consumption in each period of the plurality of periods;

when there is a first period, of the plurality of periods, in which the predicted amount of power consumption is determined to exceed the target value, causing a display of the information terminal to display a first screen including a time-sequence diagram of the plurality of periods, in which the first period is displayed distinctively from a second period of the plurality of periods, where the predicted amount of power consumption in the second period is determined not to exceed the target value; and causing the display to display a second screen including a message that presents an action to be performed in the second period to reduce the amount of power consumption in the first period to be less than the target value, wherein a content of the message displayed on the display is changed according to a grace period before the first period starts, and wherein the message is displayed when the grace period is a second grace period that is longer than a first grace period, and the message is not displayed when the grace period is the first grace period.

10. The information terminal control method according to claim 1, wherein the action includes at least one of carrying in merchandise into a refrigerating showcase, replenishing of merchandise into a refrigerating showcase, carrying in merchandise into a freezing showcase, or replenishing of merchandise into a freezing showcase.

11. The information terminal control method according to claim 1, wherein the action includes food heating.

12. The information terminal control method according to claim 10, wherein the message is displayed more often in a time period during which air temperature is a second temperature that is lower than a first temperature than in a time period during which the air temperature is the first temperature.

13. The information terminal control method according to claim 1, wherein the action includes an operation of lowering an amount of power that is consumed by at least either an air-conditioning facility or a lighting facility.

14. The information terminal control method according to claim 1, wherein the action includes at least either an action that leads to a reduction in amount of insolation to the area or an action of sprinkling water in premises of the area.

15. The information terminal control method according to claim 14, wherein the message is displayed more often in a time period during which air temperature is a first temperature that is higher than a second temperature than in a time period during which the air temperature is the second temperature.

16. The information terminal control method according to claim 1, further comprising displaying, on the display, a third screen that reports that the first period has come.

17. The information terminal control method according to claim 1, further comprising:

displaying, on the display, a peak value of an amount of power consumption in the area during each month; and while the peak value is being displayed, receiving an input of the target value by an operator.

18. An energy conservation support system comprising:

a memory that stores instructions; and a processor that, when executing the instructions stored in the memory, performs operations including:

predicting an amount of power consumption in an area in each period of a plurality of periods;

determining whether the predicted amount of power consumption in each period of the plurality of periods exceeds a target value of the power consumption in each period of the plurality of periods;

when there is a first period, of the plurality of periods, in which the predicted amount of power consumption is determined to exceed the target value, causing a display of an information terminal to display a first screen including a time-sequence diagram of the plurality of periods in which the first period is displayed distinctively from a second period of the plurality of periods, where the predicted amount of power consumption in the second period is determined not to exceed the target value; and causing the display to display a second screen including a message that presents an action to be performed in the second period to reduce the amount of power consumption in the first period to be less than the target value, wherein a content of the message displayed on the display is changed according to a grace period before the first period starts, and wherein the action in the message that is displayed when the grace period is a first grace period requires longer time to reach a maximum reduction in the amount of power consumption than the action in the message that is displayed when the grace period is a second grace period that is shorter than the first grace period.

19. The information terminal control method according to claim 1, wherein the second period includes a period after the first period.

20. The information terminal control method according to claim 1, wherein an alarm mark is displayed in the first period to be distinctive from the second period.

21. The information terminal control method according to claim 1, wherein the first period in the time-sequence diagram is displayed with a color different from a color of the second period in the time-sequence diagram.

22. The information terminal control method according to claim 1, wherein the display is caused to display the second screen, after the first screen is displayed on the display when there is the first period in which the predicted amount of power consumption is determined to exceed the target value.

* * * * *